US009538861B2

(12) United States Patent
Young et al.

(10) Patent No.: US 9,538,861 B2
(45) Date of Patent: Jan. 10, 2017

(54) STORAGE SYSTEM

(71) Applicant: Happy Gal, LLC, Panhandle, TX (US)

(72) Inventors: Julie Young, Panhandle, TX (US); Roger Hayes, Amarillo, TX (US)

( * ) Notice: Subject to any disclaimer, the term of this patent is extended or adjusted under 35 U.S.C. 154(b) by 0 days.

(21) Appl. No.: 14/827,247

(22) Filed: Aug. 14, 2015

(65) Prior Publication Data

US 2016/0045040 A1 Feb. 18, 2016

Related U.S. Application Data

(60) Provisional application No. 62/037,210, filed on Aug. 14, 2014.

(51) Int. Cl.

| | |
|---|---|
| ***A47F 5/05*** | (2006.01) |
| ***A47F 5/02*** | (2006.01) |
| ***A47F 5/04*** | (2006.01) |
| ***A47F 5/08*** | (2006.01) |
| *A47B 51/00* | (2006.01) |

(52) U.S. Cl.

CPC . *A47F 5/05* (2013.01); *A47F 5/02* (2013.01); *A47F 5/04* (2013.01); *A47F 5/08* (2013.01); *A47B 2051/005* (2013.01)

(58) Field of Classification Search

CPC ..... A47F 5/05; A47F 5/06; A47F 5/02; A47F 5/04; A47F 5/0823; A47F 5/08; A47B 47/00; A47B 47/0066; A47B 49/004; A47B 51/00; A47B 55/00; A47B 85/00

USPC 211/107, 168, 174, 190, 194, 205; 312/108, 125, 126, 351.2

See application file for complete search history.

(56) References Cited

U.S. PATENT DOCUMENTS

| | | | | |
|---|---|---|---|---|
| 1,101,849 | A * | 6/1914 | Hines | A47B 11/00 108/95 |
| 1,610,534 | A | 12/1926 | Rice et al. | |
| 1,929,677 | A * | 10/1933 | Davis | A47B 77/16 312/202 |
| 2,326,064 | A * | 8/1943 | Pittman | A47B 49/004 211/163 |
| 2,941,669 | A * | 6/1960 | Palay | A47B 96/1425 211/1.55 |
| 3,570,412 | A | 3/1971 | Holman et al. | |
| 3,635,352 | A * | 1/1972 | Brooks | A47F 5/05 211/168 |
| 3,998,334 | A * | 12/1976 | Smith | A47F 7/16 211/163 |
| 4,232,790 | A * | 11/1980 | Serrano | G11B 33/0466 211/163 |

(Continued)

FOREIGN PATENT DOCUMENTS

| | | |
|---|---|---|
| CA | 20002314439 | 7/2000 |
| CN | 202653807 U | 1/2013 |

OTHER PUBLICATIONS https://www.google.com/patents/US20070080120?dq=US20070080120A1&hl=en&sa=X&ei=YA-WU9D-E8O2yAT42oCIBg&ved=0CCkQ6wEwAA.

(Continued)

*Primary Examiner* — James O Hansen

(74) *Attorney, Agent, or Firm* — Shannon L Warren

(57) ABSTRACT

A storage system comprising an inner rod, an outer body, an upper foot, a lower foot, and a one or more pegs. Said outer body rotatably attaches to said inner rod. Said upper foot and said lower foot press against a ceiling and a ground surface. Said inner rod comprises a tension rod having a variable length. Said one or more pegs extend out from said outer body.

18 Claims, 32 Drawing Sheets

(56) References Cited

U.S. PATENT DOCUMENTS

| | | | | |
|---|---|---|---|---|
| 4,838,625 | A * | 6/1989 | Taylor | A47B 61/00 211/163 |
| 5,033,626 | A * | 7/1991 | Platti | A47B 49/004 211/163 |
| 5,127,528 | A * | 7/1992 | Cone | A47B 96/1425 211/163 |
| 5,318,175 | A * | 6/1994 | Stevens | A47G 25/0664 211/107 |
| 5,330,061 | A | 7/1994 | Geltz | |
| 5,482,237 | A | 1/1996 | Wang | |
| 6,568,546 | B1 * | 5/2003 | Huang | A47B 49/00 211/205 |
| 7,946,543 | B2 * | 5/2011 | Cotter | A47B 61/00 211/1.53 |
| 8,408,405 | B2 | 4/2013 | Yang et al. | |
| 2007/0080120 | A1 | 4/2007 | Greiner | |
| 2013/0037503 | A1 | 2/2013 | Cimino et al. | |

OTHER PUBLICATIONS https://www.jossandmain.com/The-Organized-Closet-Hinton-Corner-Valet~WES1032~E10029.html.
https://www.google.com/search?q=site:jossandmain.com+shoe+tree&newwindow=1&es_sm=93&source=lnms&tbm=isch&sa=X&ei=J95HU5jpFsmG8QHfhYCwDQ&ved=0CAkQ_AUoAg&biw=1288&bih=774#facrc=_&imgrc=s8vczRiJcNYGWM%253A%3B6ZCE9CCR-1S3oM%3Bhttps%253A%252F%252Fsecure.img.josscdn.com%252Flf%252F53%252Fhash%252F8447%252F10099525%252F1%252FDiva%25252BShoe%25252BTree.jpg%3Bhttps%0253A%252F%252Fwww.jossandmain.com%252FBest-of-2013%25253A-Organization-Benson-Shoe-Tree~HIXK1080~E8348.html%3B450%3B450.

* cited by examiner

STORAGE SYSTEM

CROSS-REFERENCE TO RELATED APPLICATIONS

This application claims benefit of U.S. Patent Application No. 62/037,210 (filed 2014 Aug. 14), which is hereby incorporated by reference.

STATEMENT REGARDING FEDERALLY SPONSORED RESEARCH OR DEVELOPMENT (IF APPLICABLE)

Not applicable.

REFERENCE TO SEQUENCE LISTING, A TABLE, OR A COMPUTER PROGRAM LISTING COMPACT DISC APPENDIX (IF APPLICABLE)

Not applicable.

BACKGROUND OF THE INVENTION

This disclosure relates generally to a storage system. A few examples of such systems can be found in various patent records and include these record numbers: CN202653807U, US 20130037503 A1, CA20002314439 20000721, U.S. Pat. No. 1,610,534 A, U.S. Pat. No. 5,482,237 A, U.S. Pat. No. 3,570,412 A, U.S. Pat. No. 8,408,405 B2, U.S. Pat. No. 5,330,061 A, and US 20070080120 A1.

None of the above inventions and patents, taken either singularly or in combination, is seen to describe the instant disclosure as claimed. Accordingly, an improved storage system would be advantageous.

BRIEF SUMMARY OF THE INVENTION

A storage system and method of use are disclosed.

Said storage system comprising an inner rod, an outer body, an upper foot, a lower foot, and a one or more pegs. Said outer body rotatably attaches to said inner rod. Said upper foot and said lower foot press against a ceiling and a ground surface. Said inner rod comprises a tension rod having a variable length. Said one or more pegs extend out from said outer body.

A method of manufacturing a storage system comprising: manufacturing a storage system comprising of a one or more storage segments of an outer body, a one or more pegs, an inner rod, an upper foot, a lower foot, and a top segment. Said outer body rotatably attaches to said inner rod. Said upper foot and said lower foot press against a ceiling and a ground surface. Said inner rod comprises a tension rod having a variable length. Said one or more pegs extend out from said outer body.

BRIEF DESCRIPTION OF THE SEVERAL VIEWS OF THE DRAWING

FIG. 8A illustrates said storage system in a first height and said FIG. 8B illustrates said storage system in a second height.

FIG. 25B illustrates an elevated front view of said first large aperture with a cross-section view of said peg assembly there-through.

DETAILED DESCRIPTION OF THE INVENTION

Described herein is a storage system. The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1:
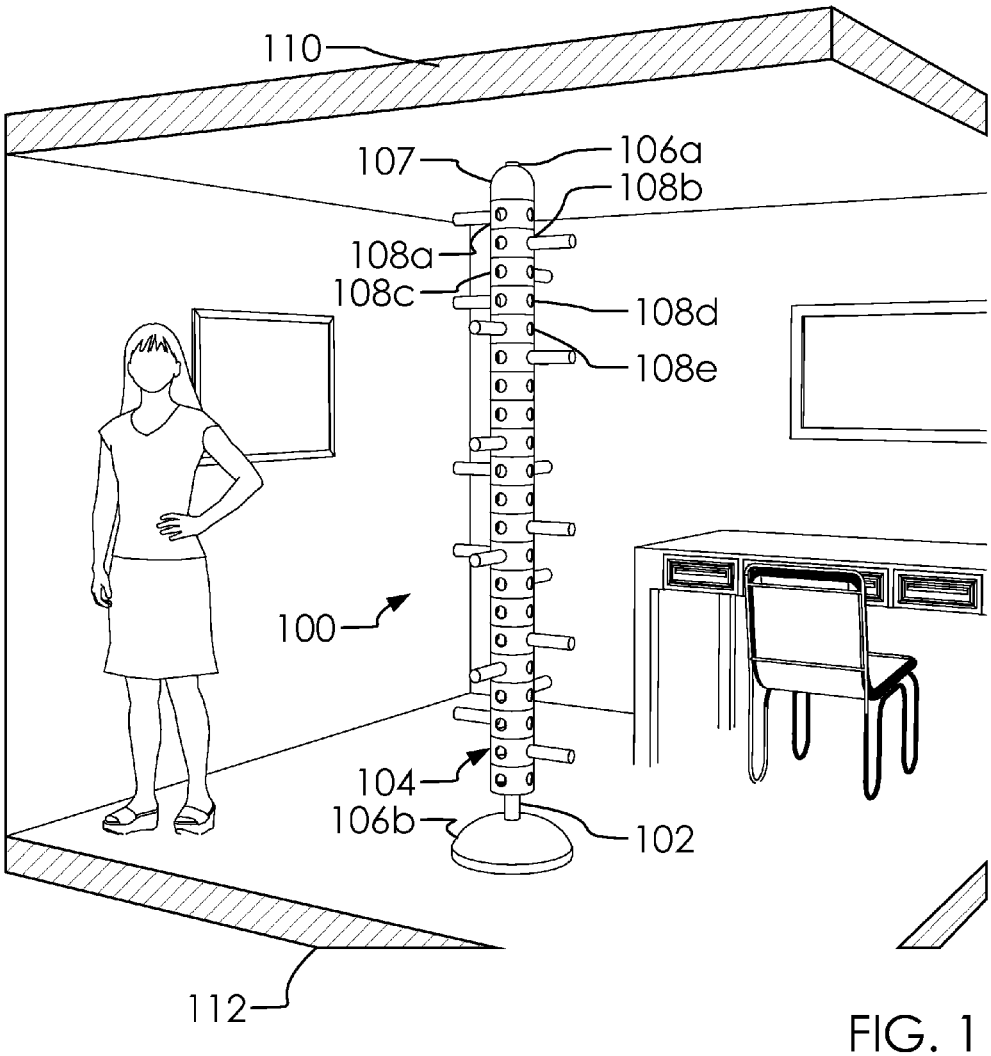
FIG. 1 illustrates a perspective overview of a storage system.

FIG. 1 illustrates a perspective overview of a storage system 100. In one embodiment, said storage system 100 can comprise an inner rod 102, an outer body 104, an upper foot 106*a*, and a lower foot 106*b*. In one embodiment, said outer body 104 can comprise a top segment 107 and a one or more storage segments. In one embodiment, said one or more storage segments can comprise a first segment 108*a*, a second segment 108*b*, a third segment 108*c*, a fourth segment 108*d*, and a fifth segment 108*e*. In one embodiment, said one or more storage segments attach to one another, as described below. In one embodiment, said one or more storage segments attach to said top segment 107. In one embodiment, said top segment 107 can attach to a portion of said inner rod 102 and/or said upper foot 106*a*.

In one embodiment, said inner rod 102 can comprise a tension rod, capable of being releasably attached between a ceiling 110 and a ground surface 112. In one embodiment, said upper foot 106*a* can create a friction surface between said storage system 100 and said ceiling 110, and said lower foot 106*b* can create a friction surface between said storage system 100 and said ground surface 112.

Said storage system 100 can be placed in a setting to display store garments. Said setting can be a retail store. A use for said storage system 100 can be to hang one or more of a t-shirt, a hat, a pair of jeans, a sweater, a pair of pants, an undergarment, and an article of clothing for display. Said storage system 100 can be used to display said hung clothing to perspective customers.

Figure 2A:
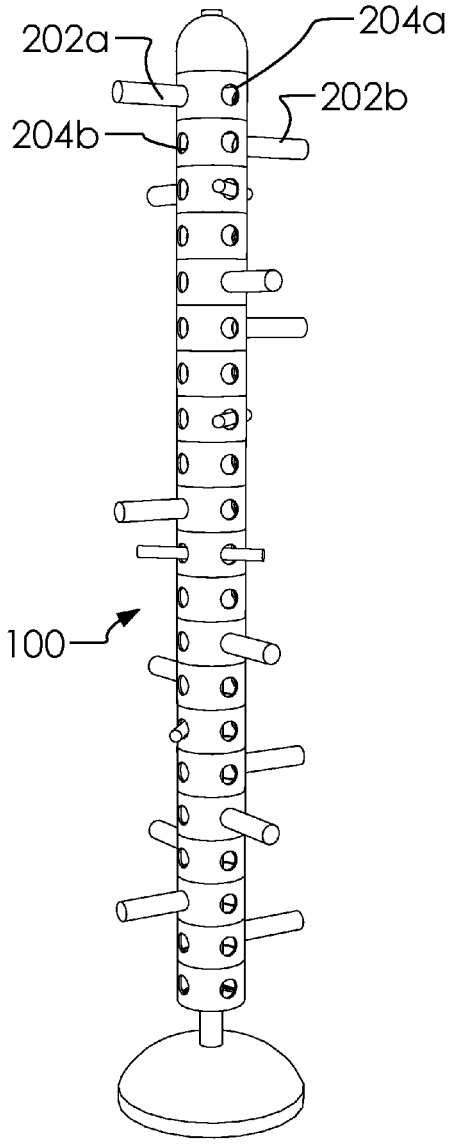
FIGS. 2A and 2B illustrate a perspective front overview and an elevated front view of said storage system.
Figure 2B:
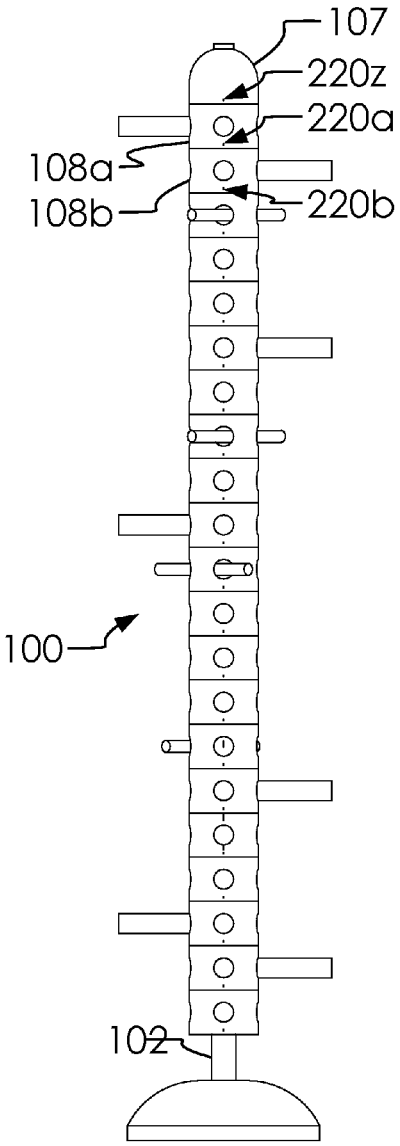

FIGS. 2A and 2B illustrate a perspective front overview and an elevated front view of said storage system 100. In one embodiment, said outer body 104 can comprise a plurality of apertures (such as a first aperture 204*a* and a second aperture 204*b*) which can receive and hold a one or more pegs (which can comprise a first peg 202*a* and a second peg 202*b*). In one embodiment, said one or more pegs can receive garments such as hats, shirts, or other items which a user of said storage system 100 may wish to hang there upon.

In one embodiment, at least two of storage segments as illustrated by 108*a*, 108*b*, 108*c*, 108*d*, and 108*e*, can be stacked one on top of another said storage segment.

In one embodiment, said storage system 100 can comprise a plurality of setscrews (such as a first setscrew 220*a*, a second setscrew 220*b*, and a top set screw 220*z*); wherein, said plurality of setscrews can attach each of said one or more storage segments to one another. For example, in one embodiment, said first segment 108*a* and said second segment 108*b* can be releasably attached to one another with said first setscrew 220*a*. In one embodiment, said plurality of setscrews can be allocated one per junction 222 between said one or more storage segments, and one between said first segment 108*a* (that is the top most among said one or more storage segments and said top segment 107.

Figure 3A:
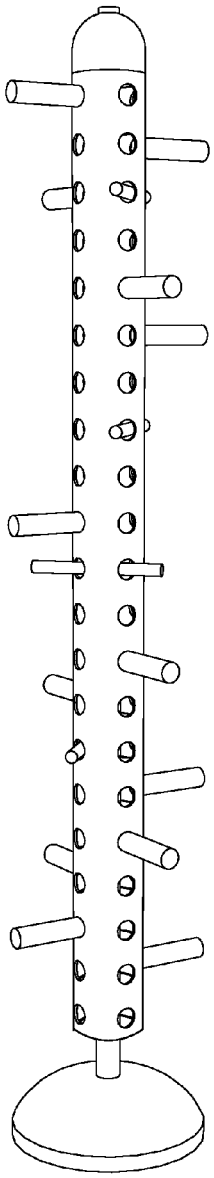
FIGS. 3A and 3B illustrate a perspective front overview and an elevated front view of a second embodiment of said storage system, referred to as a storage system.
Figure 3B:
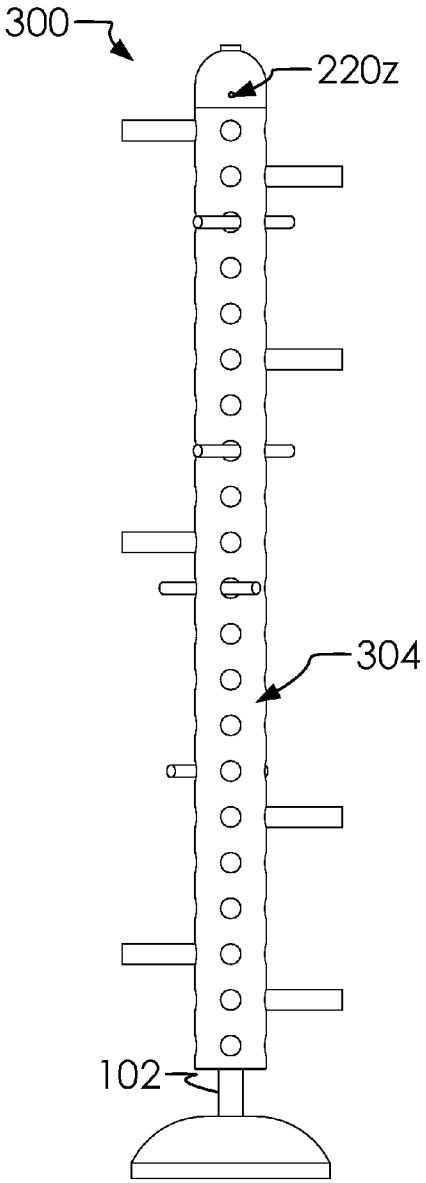

FIGS. 3A and 3B illustrate a perspective front overview and an elevated front view of a second embodiment of said storage system 100, referred to as a storage system 300. In one embodiment, said storage system 300 can be substantially similar to said storage system 100, but-for replacing said outer body 104 of said storage system 100 with an integrated outer body 304. In one embodiment, said integrated outer body 304 can comprise a single piece of molded plastic (or other material, as known in the art). Accordingly, said storage system 300 can comprise said storage system 100 without using said one or more storage segments.

Figure 4A:
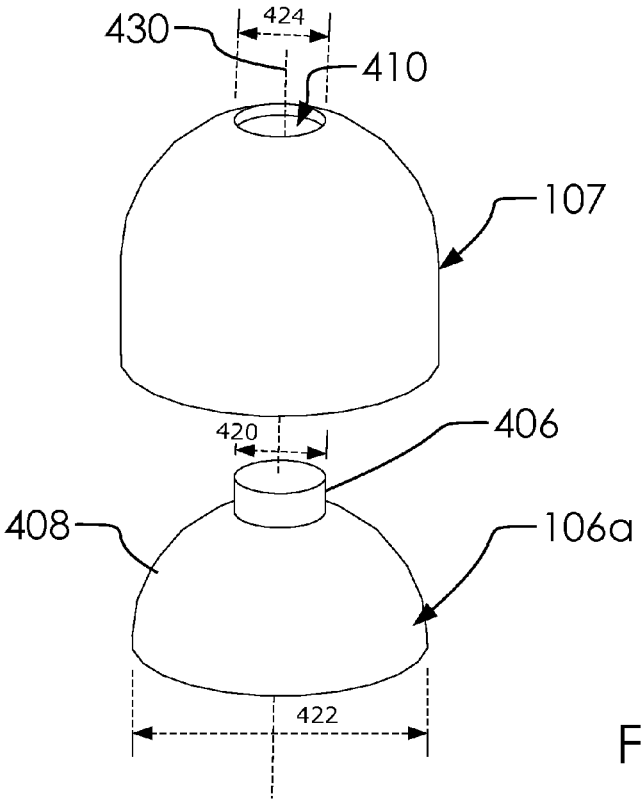
FIGS. 4A and 4B illustrate a perspective exploded overview of said top segment with said upper foot and a perspective cross-section assembled overview of said top segment with said upper foot.
Figure 4B:
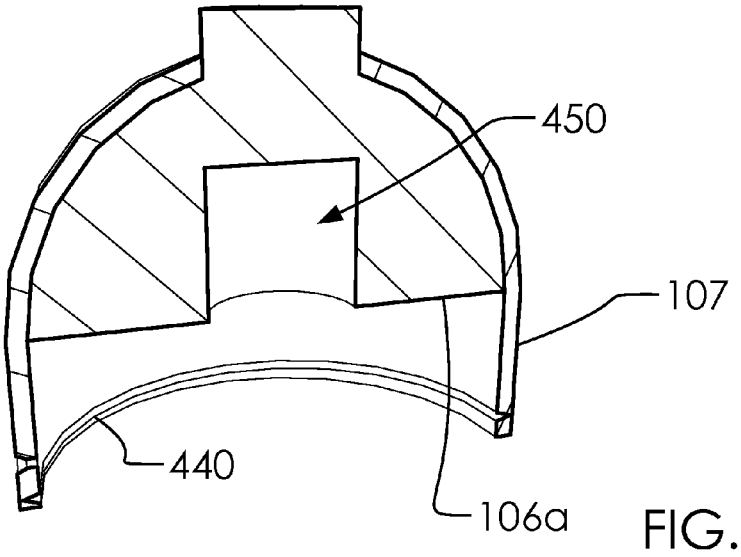

FIGS. 4A and 4B illustrate a perspective exploded overview of said top segment 107 with said upper foot 106*a* and a perspective cross-section assembled overview of said top segment 107 with said upper foot 106*a*. In one embodiment, said upper foot 106*a* can comprise a neck portion 406 and a lower portion 408. In one embodiment, said lower portion 408 can comprise a bell-shape having a first diameter 420 at said neck portion 406 and a second diameter 422 at the bottom of said lower portion 408; wherein, said second diameter 422 is larger than said first diameter 420*a*. In one embodiment, said top segment 107 can comprise a neck aperture 410 (having a neck aperture diameter 424). In one embodiment, said storage system 100 can comprise a central vertical axis 430. In one embodiment, rotatably attaching said top segment 107 to said upper foot 106*a* can comprise aligning each with said central vertical axis 430; sliding a portion of said neck portion 406 through said neck aperture 410; and resting a portion of an internal surface 432 of said top segment 107 on said lower portion 408. In one embodiment, said top segment 107 and said upper foot 106*a* can rotate relative to one another along said internal surface 432; thus, said upper foot 106*a* can remain fixed relative to said ceiling 110 and allow said top segment 107 and said outer body 104 (attached to it) to spin about said internal surface 432. In one embodiment, said top segment 107 can comprise an inner threading 440.

In one embodiment, said upper foot 106*a* can comprise a socket 450.

Figure 5A:
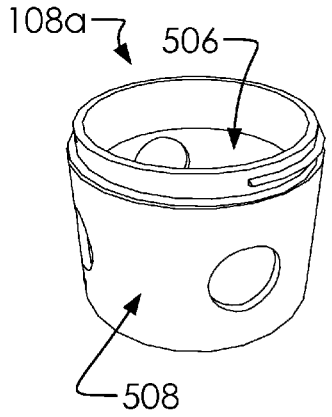
FIGS. 5A, 5B and 5C illustrate one solid line view and two wireframe views of said first segment; comprising a perspective overview in solid line, an elevated front view in wireframe, and a perspective wireframe overview in wireframe.
Figure 5B:
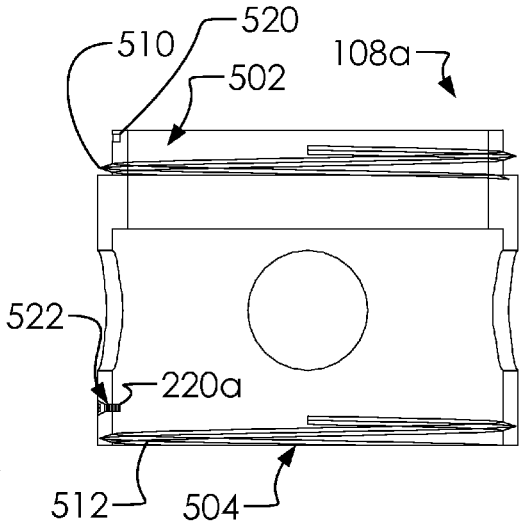
Figure 5C:
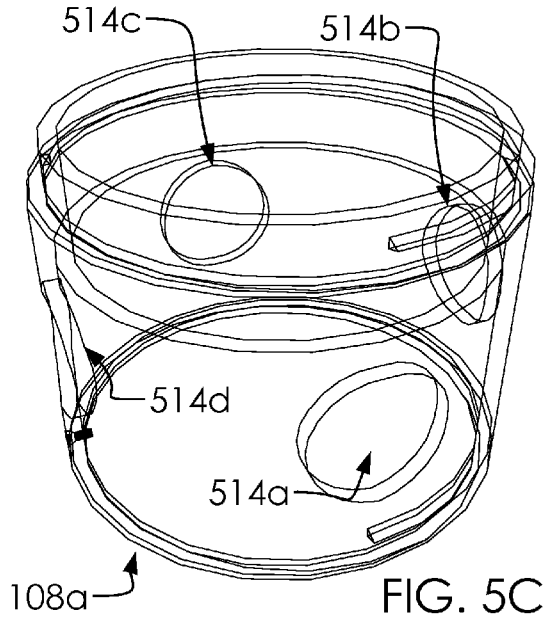

FIGS. 5A, 5B and 5C illustrate one solid line view and two wireframe views of said first segment 108*a*; comprising a perspective overview in solid line, an elevated front view in wireframe, and a perspective wireframe overview in wireframe. In one embodiment, said one or more storage segments can all have similar specifications to said first segment 108*a*, as illustrated. In one embodiment, said 108*a* can comprise a base portion 502 and a socket portion 504; wherein, said base portion 502 screws into said socket portion 504. In one embodiment, said first segment 108*a* can comprise an inner surface 506, an outer surface 508, an outer threading 510, an inner threading 512, and a one or more side apertures (which can comprise a first side aperture 514*a*, a second side aperture 514*b*, a third side aperture 514*c* and a fourth side aperture 514*d*. In one embodiment, said outer threading 510 of a first among said one or more storage segments can attach to said inner threading 512 of a second among said one or more storage segments. In one embodiment, said outer surface 508 of said one or more storage segments can comprise a round or cylindrical shape. In one embodiment, said one or more side apertures can be arranged in said outer surface 508 of said one or more storage segments, as illustrated.

Figure 5D:
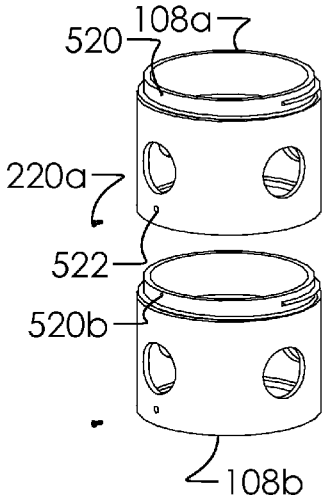
FIG. 5D illustrates an exploded perspective overview of said first segment and said second segment with said first setscrew.

FIG. 5D illustrates an exploded perspective overview of said first segment 108*a* and said second segment 108*b* with said first setscrew 220*a*. In one embodiment, said one or more storage segments can each comprise an inner setscrew socket 520 and an outer setscrew socket 522. In one embodiment, said plurality of setscrews can attach a first segment (such as said first segment 108*a*) to a second segment (such as said second segment 108*b*) of said one or more storage segments to one another by: screwing said base portion 502 of said second segment 108*b* into said socket portion 504 of said first segment 108*a*; aligning said outer setscrew socket 522 of said first segment 108*a* with an inner setscrew socket 520*b* of said second segment 108*b*; and screwing one among said plurality of setscrews (such as said first setscrew 220*a*) through said outer setscrew socket 522 of said first segment 108*a* and into said inner setscrew socket 520*b* of said second segment 108*b*.

Figure 6:
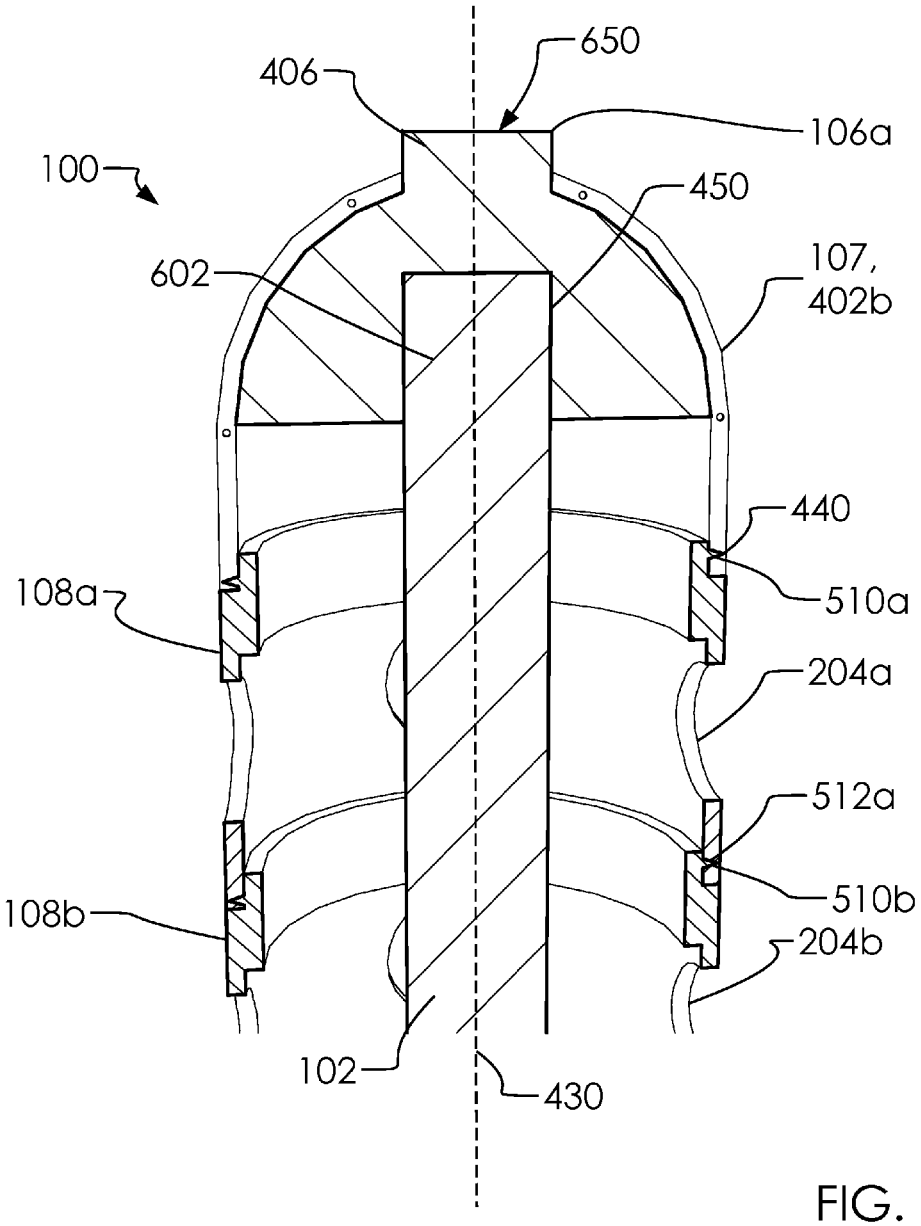
FIG. 6 illustrates a perspective cross-section overview of an upper portion of said storage system.

FIG. 6 illustrates a perspective cross-section overview of an upper portion of said storage system 100. In one embodiment, said outer body 104 can rotate around said central vertical axis 430 around said inner rod 102. In one embodiment, each among said one or more storage segments can releasably attach to one another with a procedure similar to the following procedure as between said first segment 108*a* and said second segment 108*b*: aligning said one or more storage segments around said central vertical axis 430 and around said inner rod 102; screwing a outer threading 510*b* of said second segment 108*b* into an inner threading 512*a* of said first segment 108*a*; and inserting said first setscrew 220*a* (not illustrated here) as described above. Likewise, said first segment 108*a* can releasably attach to said top segment 107 by: screwing an outer threading 510*a* of said first segment 108*a* into said inner threading 440 of said top segment 107; and setting said top set screw 220*z* through a portion of said top segment 107 and said first segment 108*a* (not illustrated here).

In one embodiment, said inner rod 102 can comprise an upper end 602. In one embodiment, said upper end 602 can slide into said socket 450.

In one embodiment, said upper foot 106*a* can comprise a top surface 650. In one embodiment, said top surface 650 can be on top of said neck portion 406. In one embodiment, said top surface 650 can comprise a high friction material like rubber, thereby securing said upper foot 106*a* to said ceiling 110 when an upward force is applied to said upper foot 106*a*.

Figure 7A:
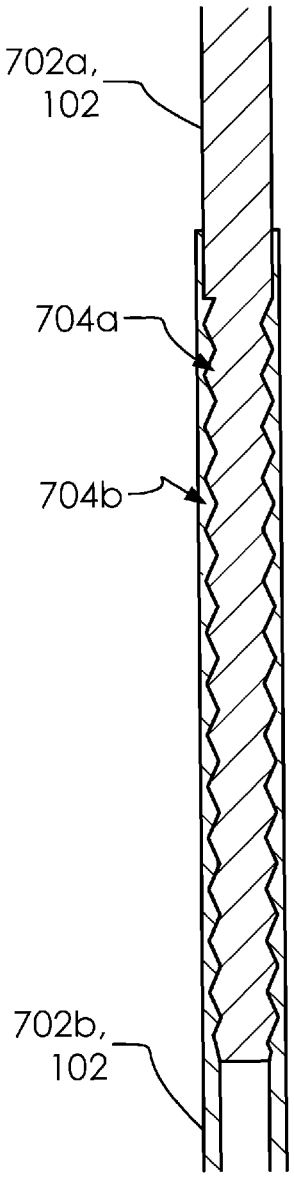
FIGS. 7A and 7B illustrate an elevated cross-section front view and a perspective cross-section overview of said inner rod.
Figure 7B:
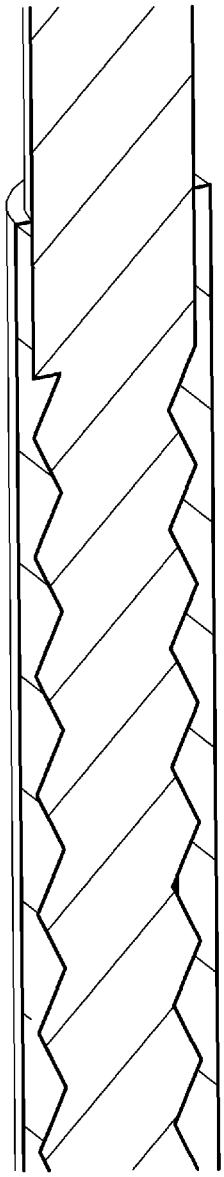

FIGS. 7A and 7B illustrate an elevated cross-section front view and a perspective cross-section overview of said inner rod 102. In one embodiment, said inner rod 102 can comprise a first rod 702*a* and a second rod 702*b*. In one embodiment, said first rod 702*a* screws into said second rod 702*b*. In one embodiment, said first rod 702*a* can comprise an outer threading 704*a* and said second rod 702*b* can comprise an inner threading 704*b*. In one embodiment, said outer threading 704*a* can screw into said inner threading 704*b*.

Figure 8A:
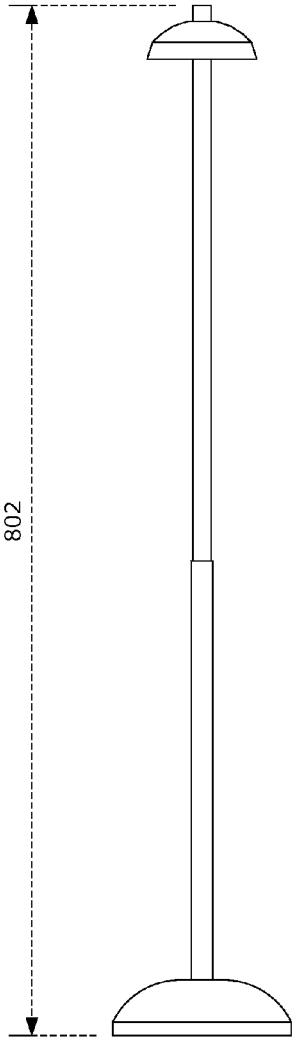
FIGS. 8A and 8B illustrate two elevated front views of said storage system (sans said outer body); wherein said
Figure 8B:
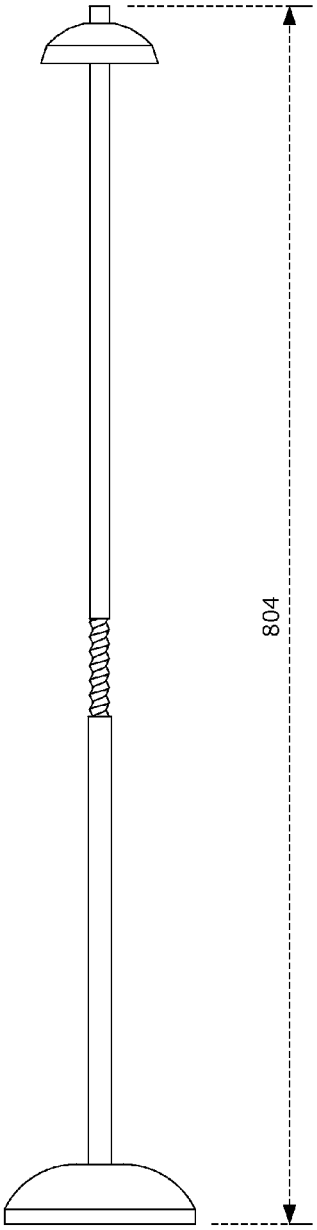

FIGS. 8A and 8B illustrate two elevated front views of said storage system 100 (sans said outer body 104); wherein said FIG. 8A illustrates said storage system 100 in a first height 802 and said FIG. 8B illustrates said storage system 100 in a second height 804. In one embodiment, said inner rod 102 can comprise an adjustable height allowing said storage system 100 to have a variable height between said ceiling 110 and said ground surface 112. For example, by adjusting said first rod 702*a* and said second rod 702*b* by twisting said outer threading 704*a* and said inner threading 704*b* relative to one another, said adjustable height can be selectively changed between said first height 802 and said second height 804.

Figure 9:
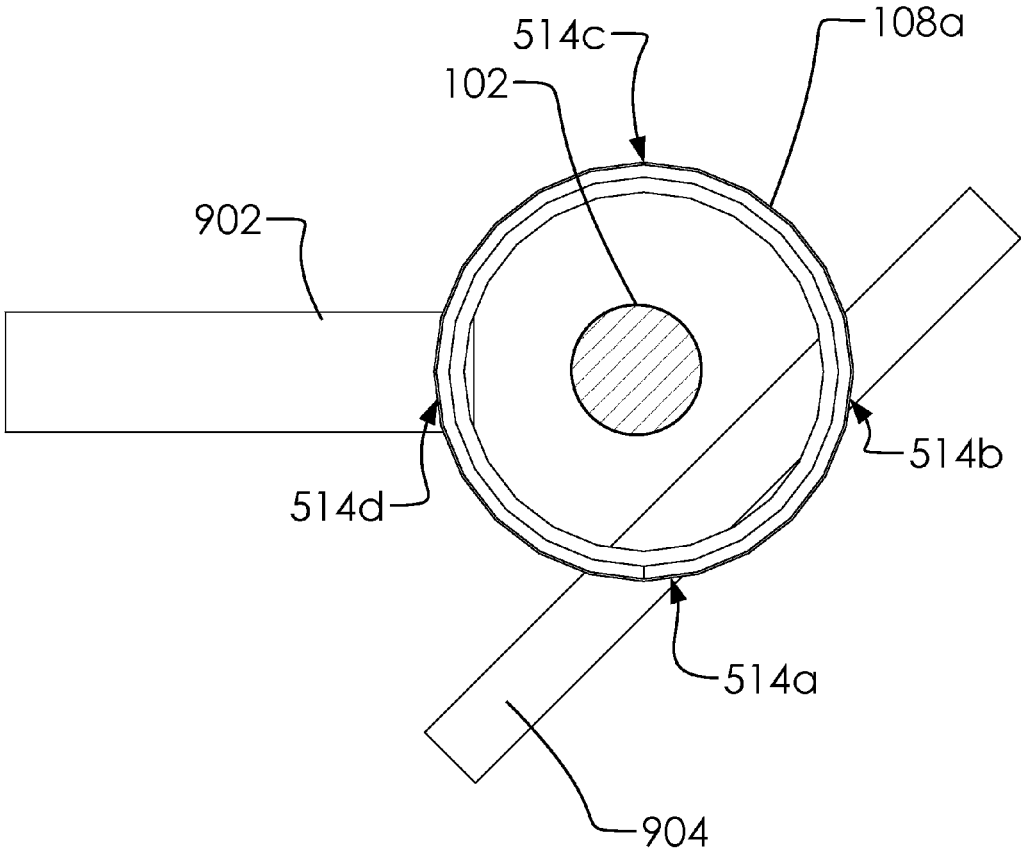
FIG. 9 illustrates an elevated top view of said first segment, a cross-section of said inner rod, a short peg and a long peg.

FIG. 9 illustrates an elevated top view of said first segment 108*a*, a cross-section of said inner rod 102, a short peg 902 and a long peg 904. In one embodiment, said short peg 902 and said long peg 904 can attach to said one or more storage segments as illustrated, or as described below. A full range of pegs and accessories can be used with said storage system 100 as one in the art would understand.

Figure 10:
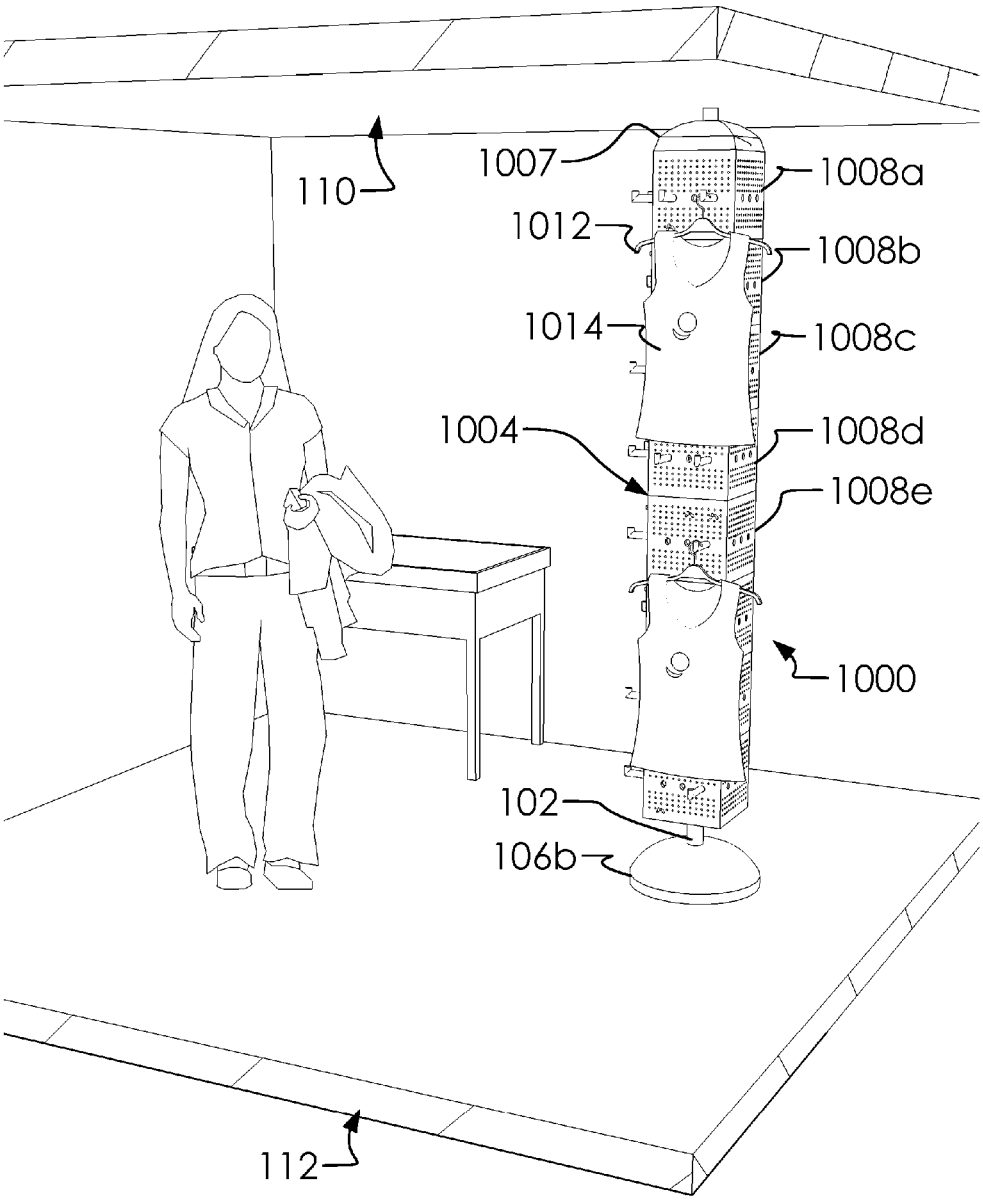
FIG. 10 illustrates a perspective overview of one embodiment of a storage system.

FIG. 10 illustrates a perspective overview of one embodiment of a storage system 1000. In one embodiment, said storage system 1000 can comprise an inner rod 102, an outer body 1004, an upper foot 106*a*, and a lower foot 106*b*. In one embodiment, said outer body 1004 can comprise a top segment 1007 and a one or more storage segments. In one embodiment, said one or more storage segments can comprise a first segment 1008*a*, a second segment 1008*b*, a third segment 1008*c*, a fourth segment 1008*d*, and a fifth segment 1008*e*. In one embodiment, said storage segments are at least one of: a cube, a rectangular cube, a box, a cuboid, and a cylinder. In one embodiment, said one or more storage segments attach to one another, as described below. In one embodiment, said one or more storage segments attach to said top segment 1007. In one embodiment, said top segment 1007 can attach to a portion of said inner rod 102 and/or said upper foot 106*a*. In one embodiment, a clothing hanger 1012 can attach to said storage system 1000. Said clothing hanger 1012 can have a shirt 1014 or other articles of clothing hung on it as is generally known.

In one embodiment, said inner rod 102 can comprise a tension rod, capable of being releasably attached between a ceiling 110 and a ground surface 112. In one embodiment, said upper foot 106*a* can create a friction surface between said storage system 1000 and said ceiling 110, and said lower foot 106*b* can create a friction surface between said storage system 1000 and said ground surface 112.

A use for said storage system 1000 can be to hang one or more of a t-shirt, said shirt 1014, a hat, a pair of jeans, a sweater, a pair of pants, an undergarment, and an article of clothing for display. Said storage system 1000 can be used to display said hung clothing to perspective customers.

Figure 11A:
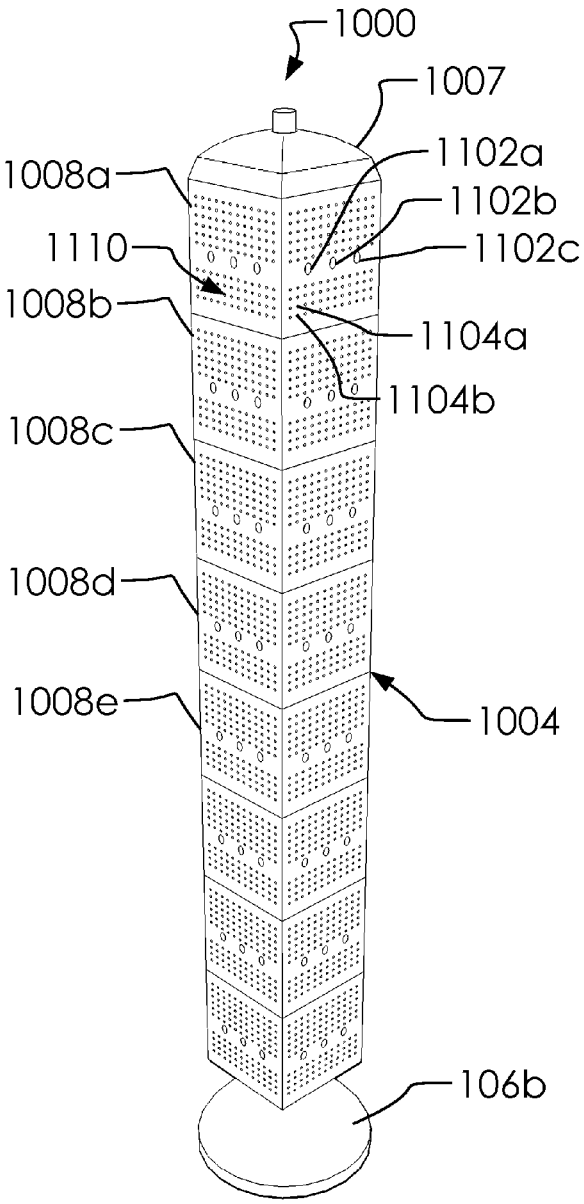
FIGS. 11A and 11B illustrate a perspective front overview of said storage system and said storage system with a one or more pegs.
Figure 11B:
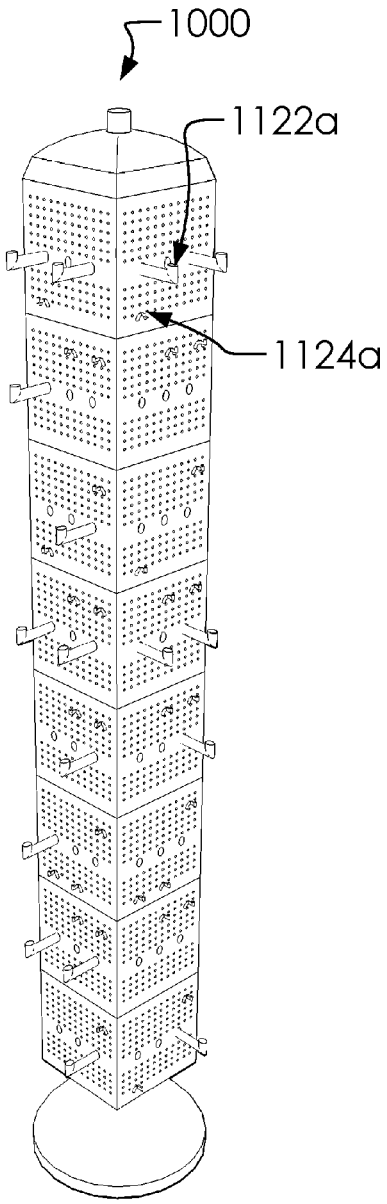

FIGS. 11A and 11B illustrate a perspective front overview of said storage system 1000 and said storage system 1000 with a one or more pegs. In one embodiment, said outer body 1004 can comprise a plurality of apertures (which can comprise a plurality of large apertures and a plurality of small apertures), which can receive and hold at least one of: a peg (described and illustrated below) a hook (described and illustrated below), and a clothing hanger 1012. In one embodiment, said plurality of large apertures can comprise a first large aperture 1102*a*, a second large aperture 1102*b*, and a third large aperture 1102*c*. In one embodiment, said plurality of small apertures can comprise a first small aperture 1104*a*, a second small aperture 1104*b*, and a third small aperture 1104*c*.

In one embodiment, a portion of said plurality of apertures can comprise a peg board 1110. In one embodiment, said peg board 1110 can comprise said plurality of small apertures.

In one embodiment, said storage system 1000 can comprise a plurality of pegs capable of releasably attaching to said plurality of apertures. In one embodiment, said plurality of pegs can comprise a one or more large pegs and a one or more small pegs. In one embodiment, said one or more large pegs can fit in said plurality of large apertures, and said one or more small pegs can fit in said plurality of small apertures. In one embodiment, said one or more large pegs can comprise a first large peg 1122*a* and said one or more small pegs can comprise a first small peg 1124*a*, as illustrated.

In one embodiment, at least two of said one or more storage segments can be releasably stacked and attached to one another. In one embodiment, a highest storage segment (which can comprise said first segment 1008*a*) connects to said top segment 1007.

Figure 12:
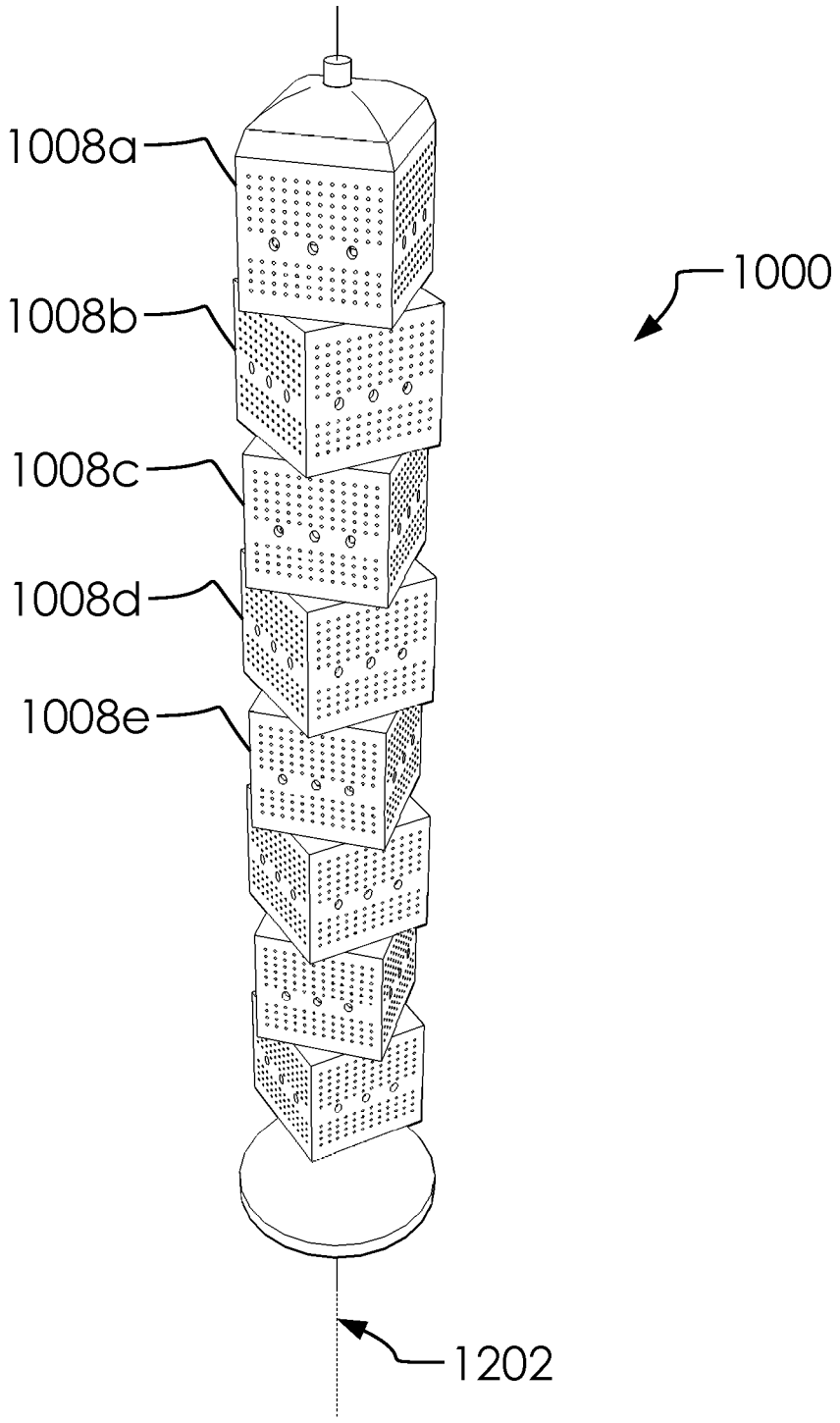
FIG. 12 illustrates a perspective front overview of said storage system.

FIG. 12 illustrates a perspective front overview of said storage system 1000. In one embodiment said outer body 1004 of said storage system 1000 rotates horizontally. In one embodiment at least one storage segment among said one or more storage segments can rotate about a central vertical axis 1202. In one embodiment, a rotating force that causes said outer body 1004 to rotate originates from a user's hand. In one embodiment, a rotating force that causes at least one of said one or more storage segments to rotate originates from a user. In one embodiment, said one or more storage segments can attach to one another in an aligned configuration (as in FIG. 11) or in a non-aligned configuration (as illustrated here in FIG. 12); wherein, said non-aligned configuration indicates that at least one among said one or more storage segments has an exterior planar surface which is not substantially parallel with other exterior planar surfaces of said one or more storage segments.

In one embodiment, said outer body 1004 rotates about said central vertical axis 1202 relative to said lower foot 106*b* and or said upper foot 106*a*.

In one embodiment, said top segment 1007 can releasably attach to said first segment 1008*a*. In one embodiment, said top segment 1007 can rotate along with said first segment 1008*a* relative to said central vertical axis 1202.

Figure 13A:
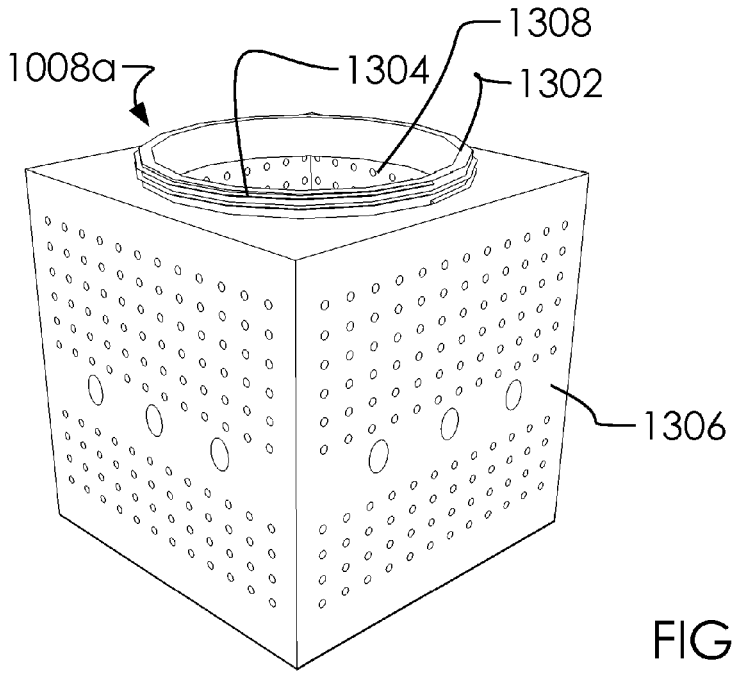
FIGS. 13A, 13B and 13C illustrate a perspective front overview, an elevated top view of said first storage segment of said storage system, and an elevated wireframe front view of said first segment.
Figure 13B:
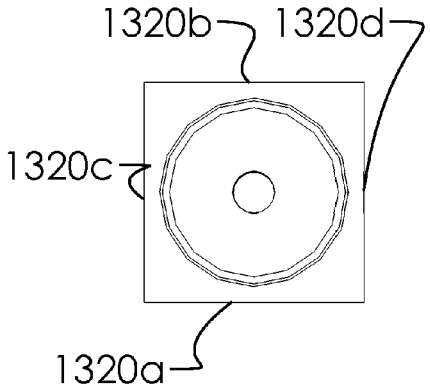
Figure 13C:
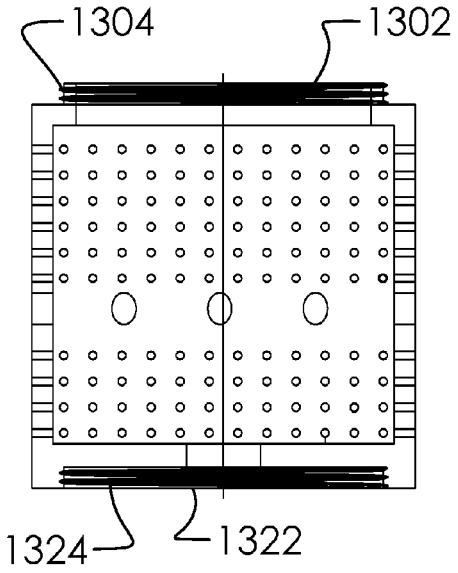

FIGS. 13A, 13B and 13C illustrate a perspective front overview, an elevated top view of said first storage segment 1008*a* of said storage system 1000, and an elevated wire-frame front view of said first segment 1008*a*. In one embodiment, said first storage segment 1008*a* can comprise a base portion 1302, a threaded portion 1304, an outer surface 1306, an inner surface 1308, said plurality of apertures, and a socket 1322 having an internal threading 1324.

In one embodiment, said first segment 1008*a* comprises a first side panel 1320*a*, a second side panel 1320*b*, a third side panel 1320*c*, and a fourth side panel 1320*d*. In one embodiment said first side panel 1320*a*, second side panel 1320*b*, third side panel 1320*c*, and fourth side panel 1320*d* can comprise congruent parts.

In one embodiment, attaching said one or more storage segments to one another comprises screwing said threaded portion 1304 of a lower segment in to said socket 1322 of an upper segment. In one embodiment, said one or more storage segments can comprise said plurality of setscrews as discussed above (but not illustrated here, as their functionality is substantially identical).

Figure 14:
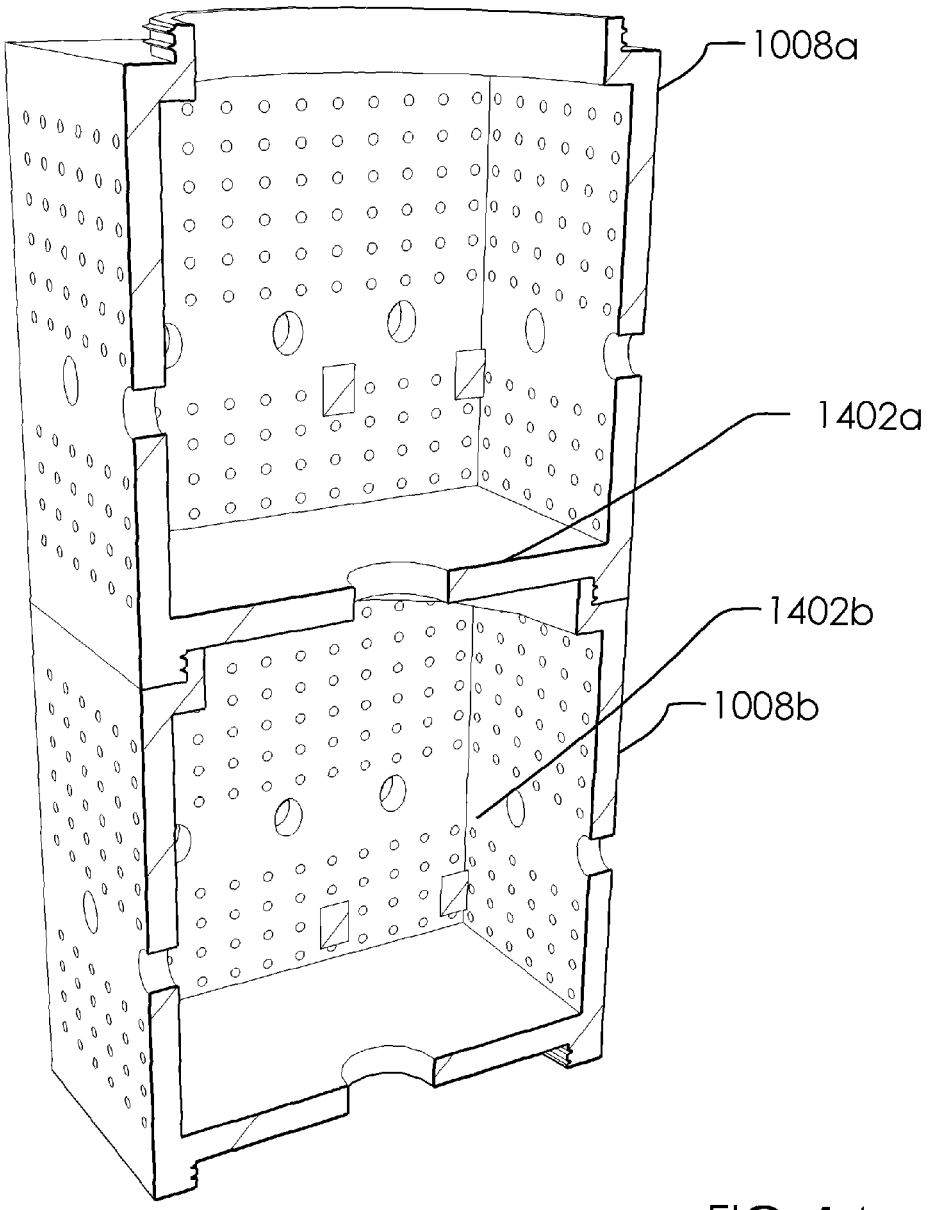
FIG. 14 illustrates a perspective cross-section overview of said first segment and said second segment attached to one another.

FIG. 14 illustrates a perspective cross-section overview of said first segment 1008*a* and said second segment 1008*b* attached to one another. In one embodiment, each among said one or more storage segments can comprise a central support (such as a central support 1402*a* for said first segment 1008*a* and a central support 1402*b* for said second segment 1008*b*). In one embodiment, said central supports can wrap around a portion of said inner rod 102 and provide horizontal stability of said one or more storage segments relative to said inner rod 102.

Figure 15A:
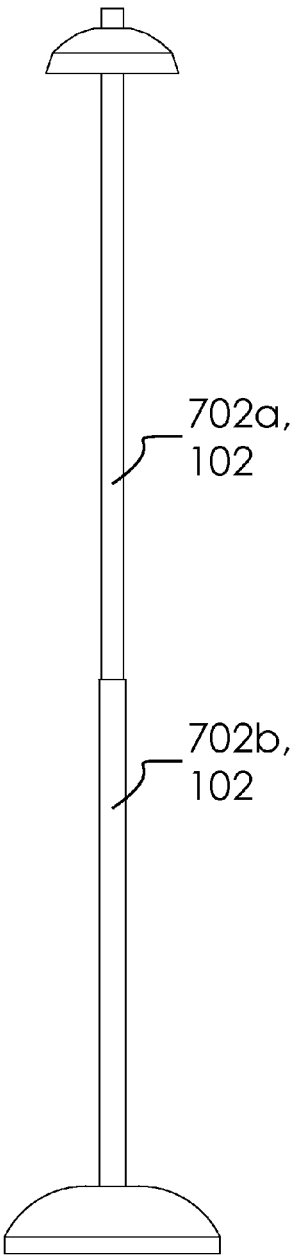
FIGS. 15A and 15B illustrate an elevated front side view and an elevated front side cross-section view of said inner rod with said upper foot, said lower foot and said top segment.
Figure 15B:
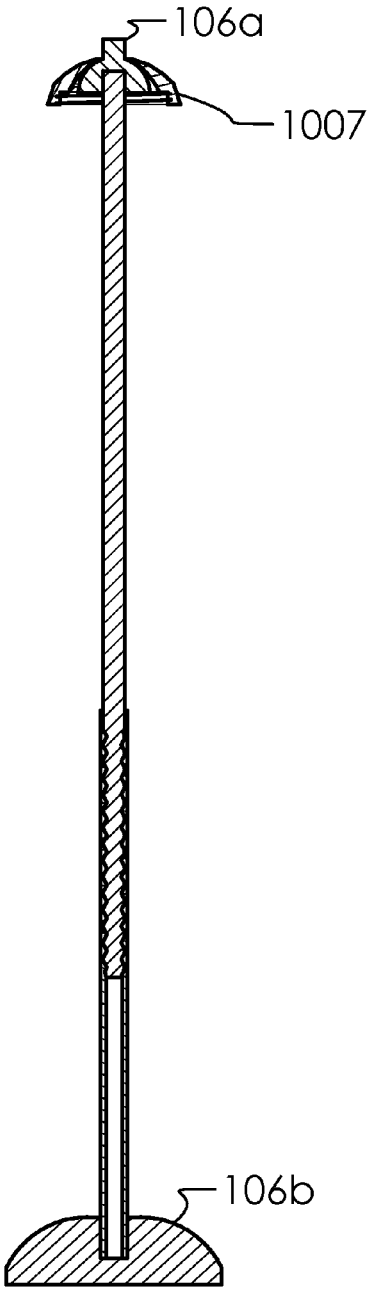

FIGS. 15A and 15B illustrate an elevated front side view and an elevated front side cross-section view of said inner rod 102 with said upper foot 106*a*, said lower foot 106*b* and said top segment 1007.

Figure 16:
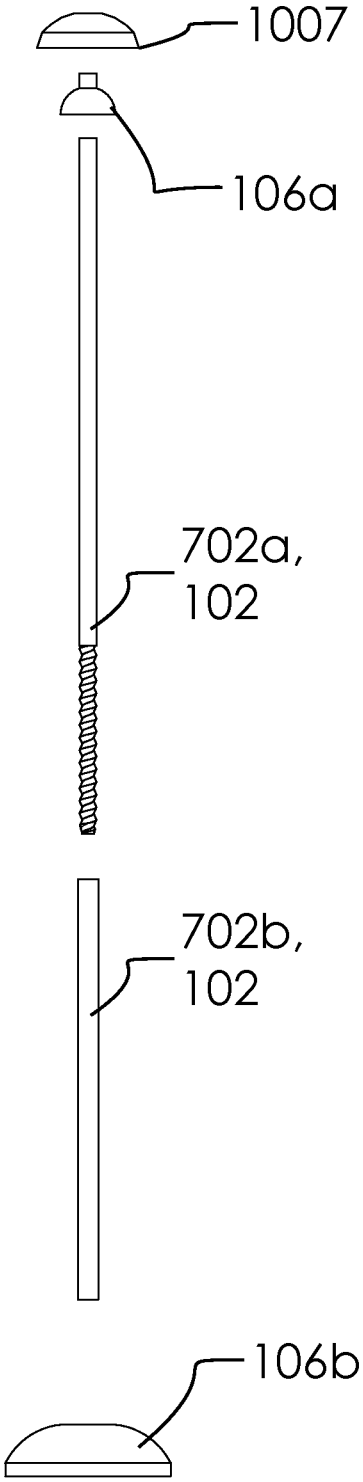
FIG. 16 illustrates at elevated exploded front side view of said storage system sans one or more storage segments.

FIG. 16 illustrates at elevated exploded front side view of said storage system 1000 sans one or more storage segments.

Figure 17:
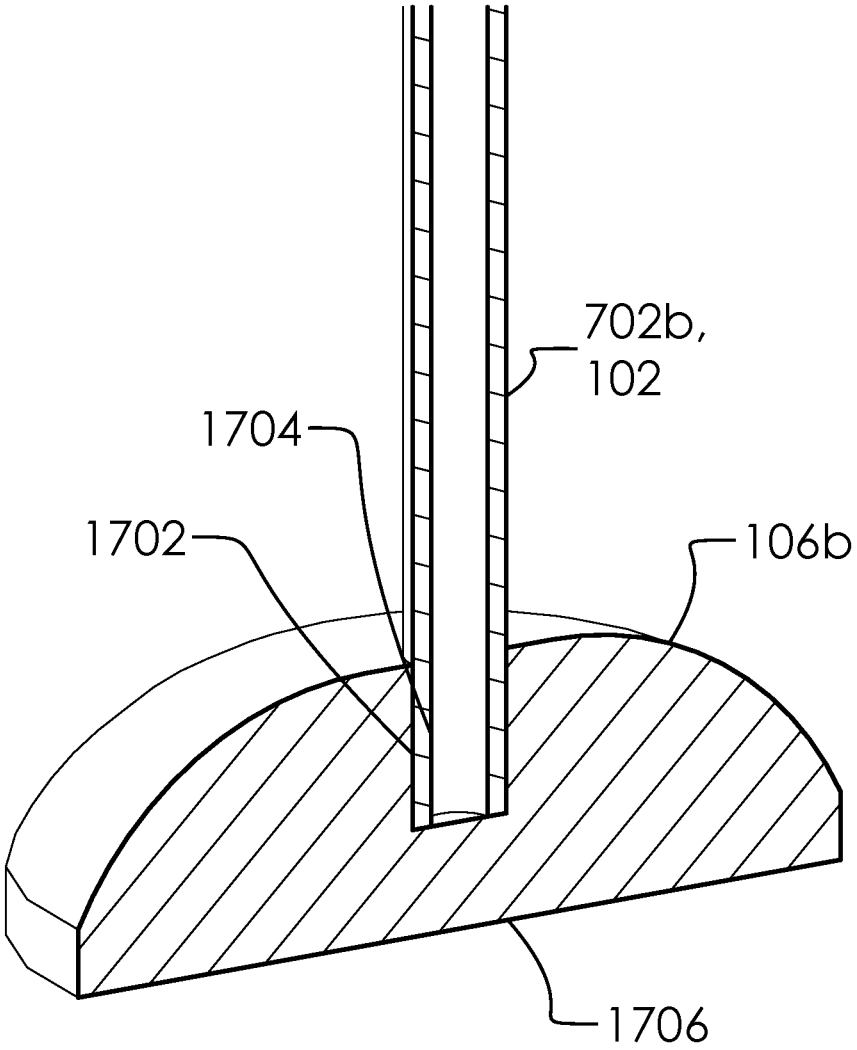
FIG. 17 illustrates a perspective front side cross-section view of said lower foot and said second rod.

FIG. 17 illustrates a perspective front side cross-section view of said lower foot 106*b* and said second rod 702*b*. In one embodiment, said second rod 702*b* can comprise a lower end 1704. In one embodiment, said lower foot 106*b* can comprise a socket 1702. In one embodiment, said lower end 1704 can slide into said socket 1702 and secure a lower portion of said inner rod 102. In one embodiment, said lower foot 106*b* can comprise a bottom surface 1706 which can comprise a high friction material like rubber, thereby securing said storage system 1000 (or said storage system 100) to said ground surface 112.

Figure 18A:
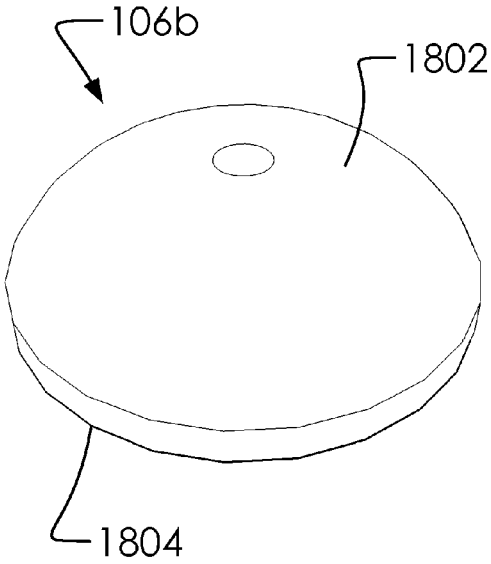
FIG. 18A illustrates a perspective view of said lower foot.
Figure 18B:
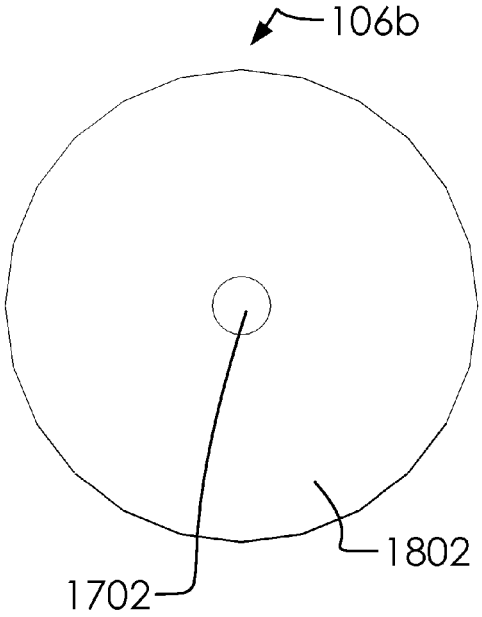
FIG. 18B illustrates an elevated top view of said lower foot.
Figure 18C:
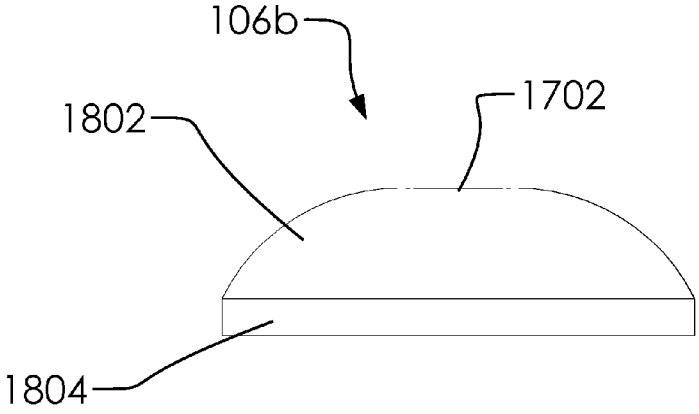
FIG. 18C illustrates an elevated side view of said lower foot.

FIG. 18A illustrates a perspective view of said lower foot 106*b*. FIG. 18B illustrates an elevated top view of said lower foot 106*b*. FIG. 18C illustrates an elevated side view of said lower foot 106*b*. In one embodiment, said lower foot 106*b* comprises a top surface 1802, a lower surface 1804, and said socket 1702.

In one embodiment, said top surface 1802 can have a dome shape. In one embodiment, said lower surface 1804 can have a flat bottom. In one embodiment, said socket 1702 can be placed on the vertex of said top surface 1802. In one embodiment, said lower foot 106*b* can comprise a puck shaped lower surface and a dome like top surface. In one embodiment, said lower foot 106*b* can comprise a flat lower surface and a dome shaped upper surface. In one embodiment said lower foot 106*b* can comprise a flat lower surface and a geometric shaped upper surface including, but not limited to, a cube, rectangular cube, a prism, and related shapes.

Figure 19A:
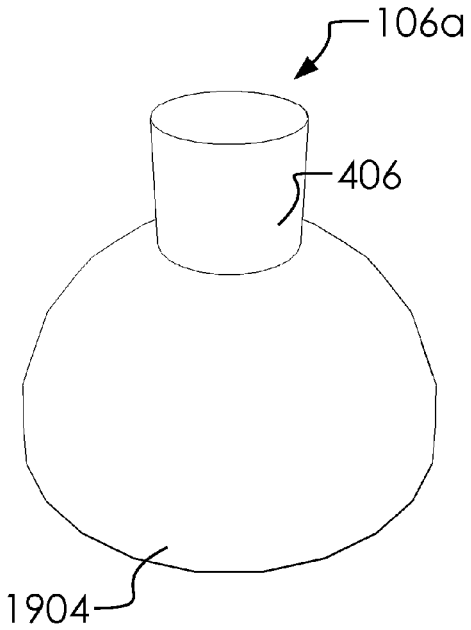
FIG. 19A illustrates a perspective view of said upper foot.
Figure 19B:
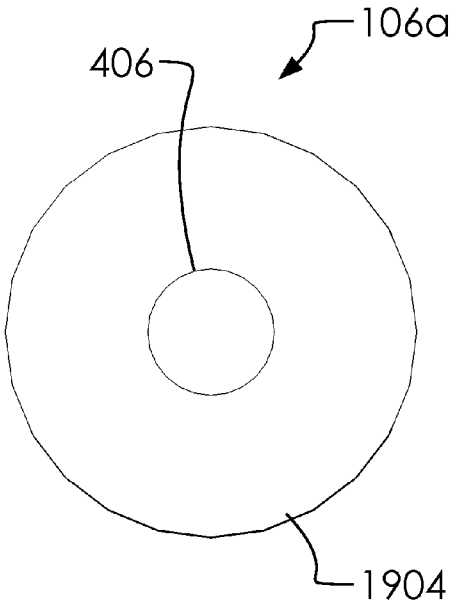
FIG. 19B illustrates a top elevated view of said upper foot.
Figure 19C:
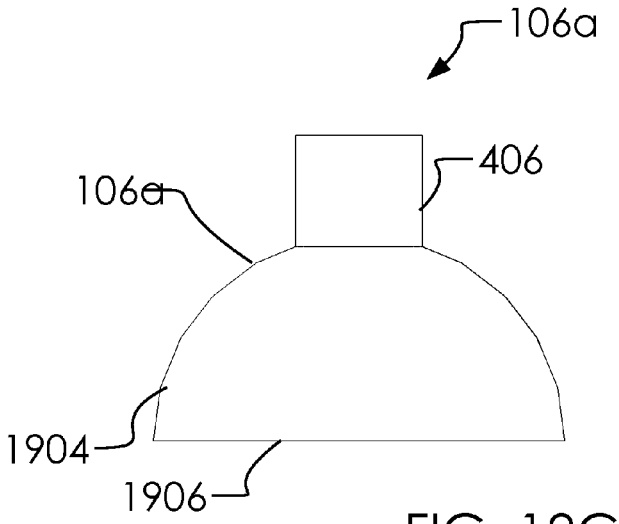
FIG. 19C illustrates an elevated side view of said upper foot.

FIG. 19A illustrates a perspective view of said upper foot 106*a*. FIG. 19B illustrates a top elevated view of said upper foot 106*a*. FIG. 19C illustrates an elevated side view of said upper foot 106*a*. Said upper foot 106*a* comprises a neck portion 406, an upper surface 1904, and a lower surface 1906. In one embodiment, said neck portion 406 can comprise a cylindered shape. In one embodiment, said neck portion 406 can comprise at least one of the following: a cube, a rectangular cube, a prism, and a geometric shape. In one embodiment, said upper surface 1904 can comprise a dome shape. In one embodiment, said lower surface 1906 can comprise a flat surface.

Figure 20:
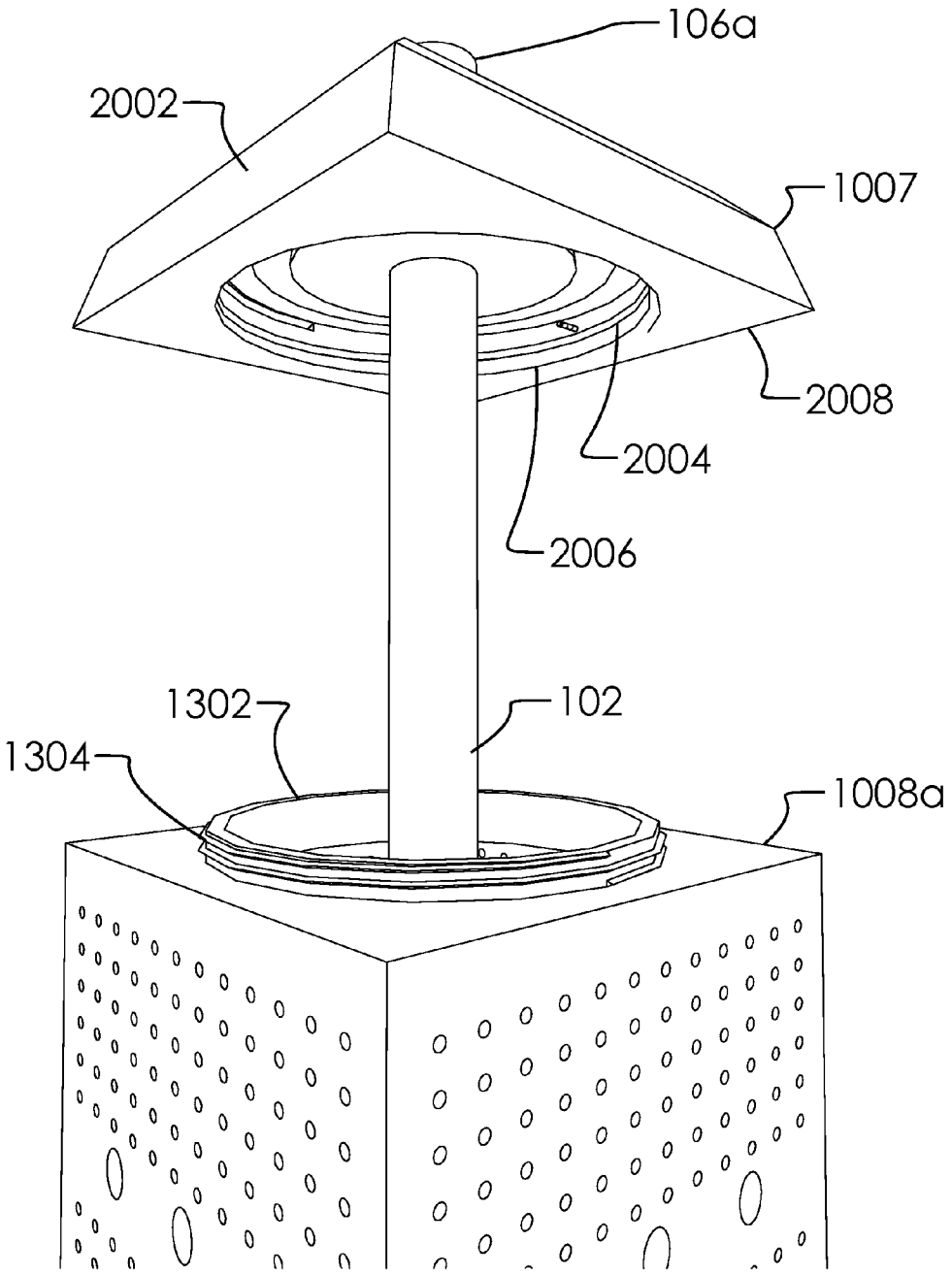
FIG. 20 is a perspective front side view of said top segment, said first segment, said inner rod, and said upper foot.

FIG. 20 is a perspective front side view of said top segment 1007, said first segment 1008*a*, said inner rod 102, and said upper foot 106*a*. In one embodiment, said top segment 1007 can comprise an outer surface 2002, and an internal threading 2004 in a socket 2006. In one embodiment, said outer surface 2002 can comprise a square base 2008. In one embodiment, said socket 2006 can releasably hold one among said one or more storage segments. For example, in one embodiment, said first segment 1008*a* can attach to said top segment 1007 by screwing said threaded portion 1304 of said base portion 1302 into said internal threading 2004 of said socket 2006.

Figure 21A:
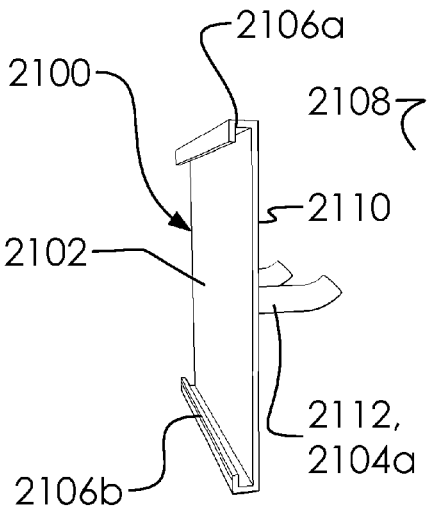
FIG. 21A illustrates a perspective view of a poster hanger assembly.

FIG. 21A illustrates a perspective view of a poster hanger assembly 2100. In one embodiment said poster hanger assembly comprises a front side 2102, a back side 2110, at least one curved peg 2112, an upper fold 2106*a*, and a lower fold 2106*b*. In one embodiment, said poster hanger assembly comprises a first curved peg 2104*a* and a second curved peg 2104*b*.

Figure 21B:
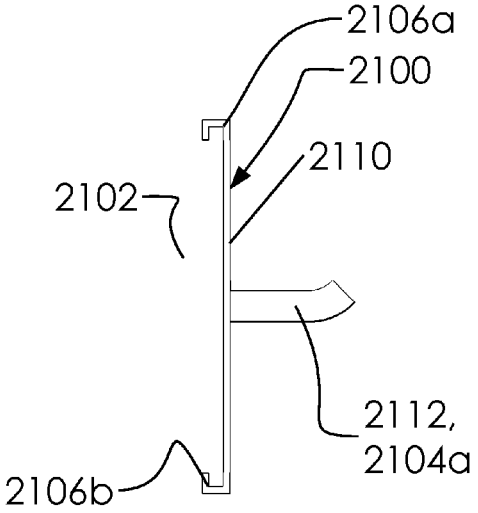
FIG. 21B is a side elevated view of said poster hanger assembly.

FIG. 21B is a side elevated view of said poster hanger assembly 2100. In one embodiment, said upper fold 2106*a* can comprise an 'L' shape fold. Said lower fold 2106*b* can comprise an L shape fold. In one embodiment, said upper fold 2106*a* can comprise a curve shape. In one embodiment, said lower fold 2106*b* can comprise a curve shape. In one embodiment a poster 2108 can slide into said poster hanger assembly 2100. In one embodiment, said poster 2108 can be at least one of the following: a flyer, a written document, a cardboard sheet, a plastic sheet, and a thin rectangular object. In one embodiment, said upper fold 2106*a* and lower fold 2106*b* prevent said poster 2108 from moving vertically.

Figure 21C:
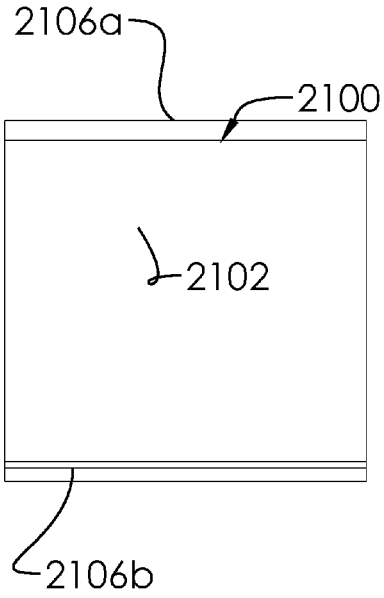
FIG. 21C illustrates the front elevated view of the poster hanger assembly.

FIG. 21C illustrates the front elevated view of the poster hanger assembly 2100.

Figure 21D:
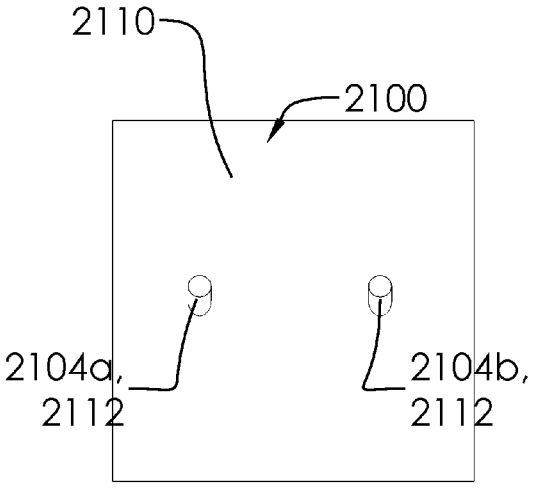
FIG. 21D illustrates the rear elevated view of the poster hanger assembly.

FIG. 21D illustrates the rear elevated view of the poster hanger assembly 2100. In one embodiment said poster hanger assembly has a back side 2110. In one embodiment, said first curved peg 2104*a* and said second curved peg 2104*b* latch on to the back side 2110 of poster hanger assembly 2100.

Figure 22A:
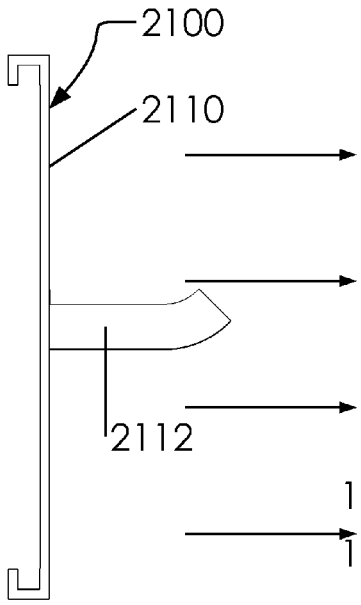
FIG. 22A illustrates a side elevated view of said poster hanger assembly.

FIG. 22A illustrates a side elevated view of said poster hanger assembly 2100. Said back side 2110 of said poster hanger assembly 2100 attaches to said first segment 1008*a*. In one embodiment said poster hanger assembly attaches to said one or more storage segments.

Figure 22B:
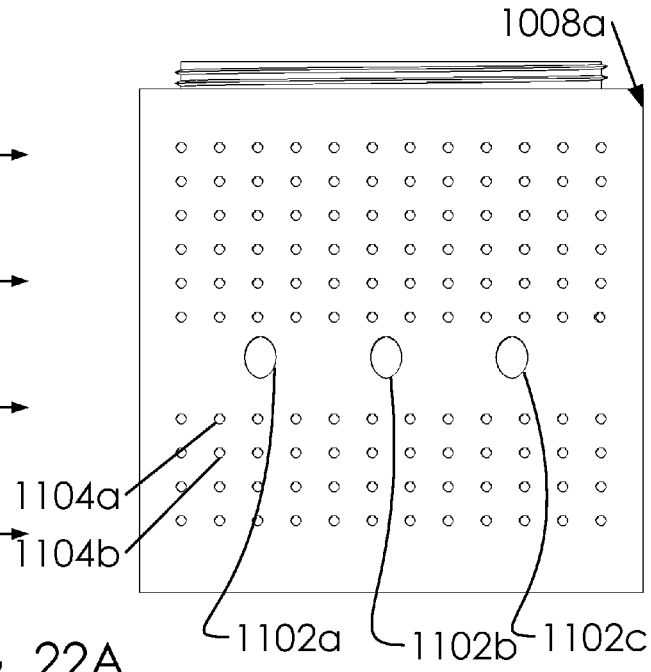
FIG. 22B illustrates an elevated view of said first segment before said poster hanger assembly fits into said first segment.

FIG. 22B illustrates an elevated view of said first segment 1008*a* before said poster hanger assembly 2100 fits into said first segment 1008*a*. In one embodiment, said poster hanger assembly 2100 attaches to said one or more storage segments.

Figure 22C:
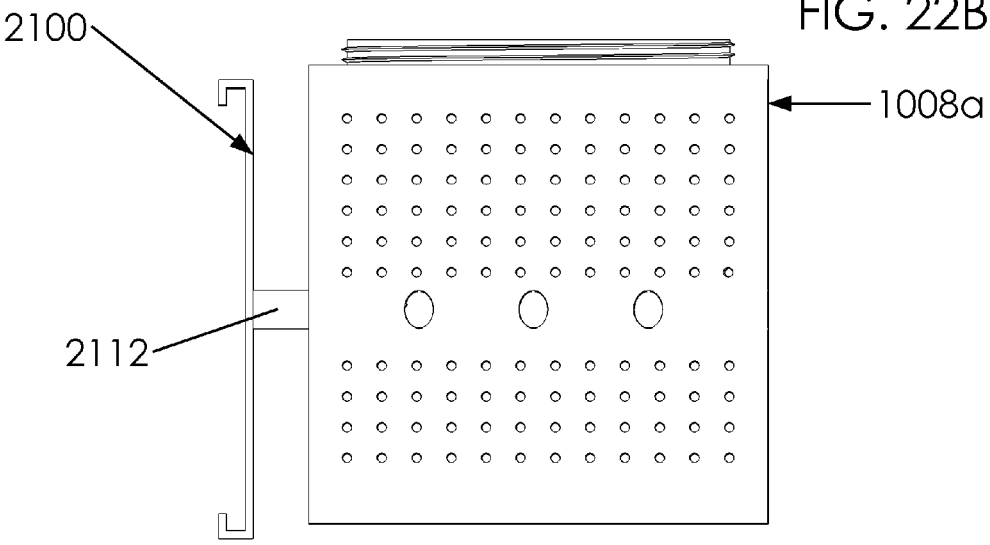
FIG. 22C illustrates an elevated view of said poster hanger assembly latched on inserted into said first segment.

FIG. 22C illustrates an elevated view of said poster hanger assembly 2100 latched on inserted into said first segment 1008*a*. In one embodiment, said poster hanger assembly attaches to said first segment 1008*a* when said first curved peg 2104*a* and second curved peg 2104*b* are inserted into one or more of said first large aperture 1102*a*. In one embodiment, said curved portion ### of said first curved peg 2104*a* and second curved peg 2104*b* prevent said poster hanger assembly 2100 from coming out of said first segment 1008*a* unless said poster hanger assembly is lifted and tilted to allow said curved portion ### to slide out said first large aperture 1102*a*. In one embodiment said post hanger assembly 2100 can fit into any segments of said outer body 104.

Figure 23A:
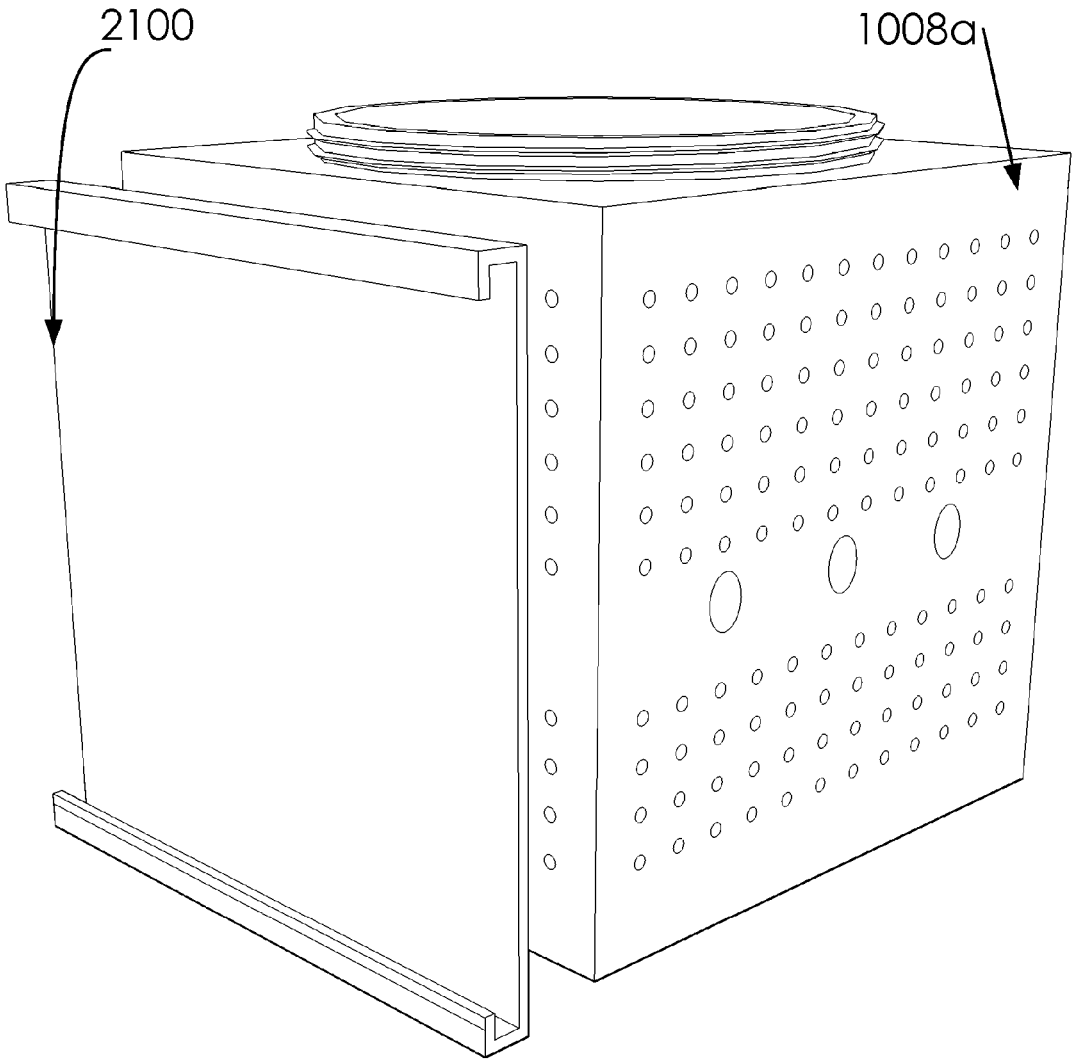
FIG. 23A illustrates a perspective view of FIG. 22C, showing said poster hanger assembly inserted into said first segment.

FIG. 23A illustrates a perspective view of FIG. 22C, showing said poster hanger assembly 2100 inserted into said first segment 1008*a*.

Figure 24A:
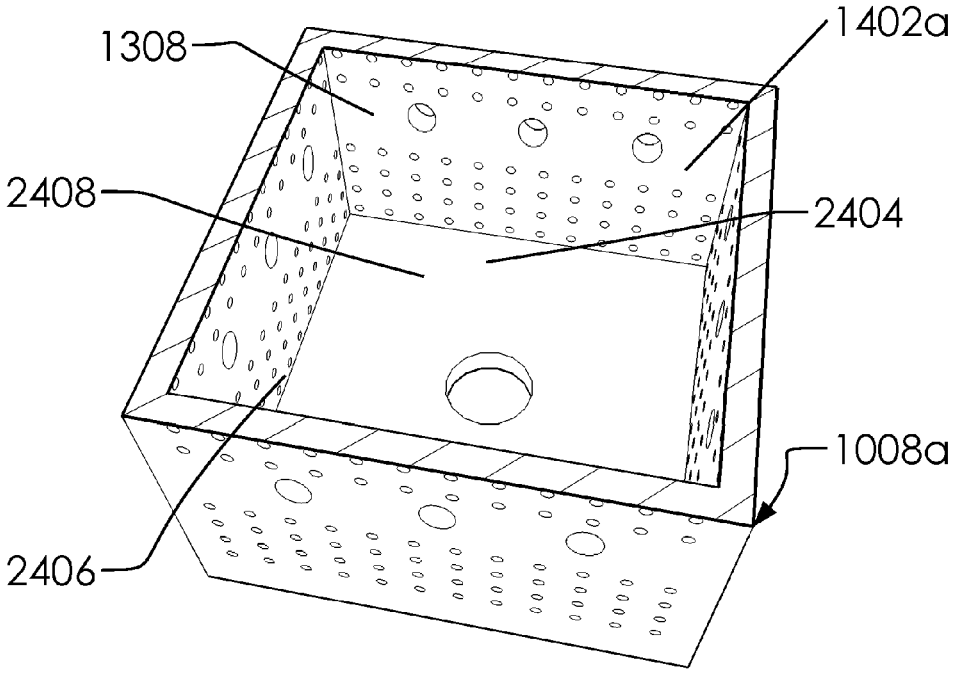
FIG. 24A is an elevated view of said one or more storage segments such as first segment.

FIG. 24A is an elevated view of said one or more storage segments such as first segment 1008*a*.

Figure 24B:
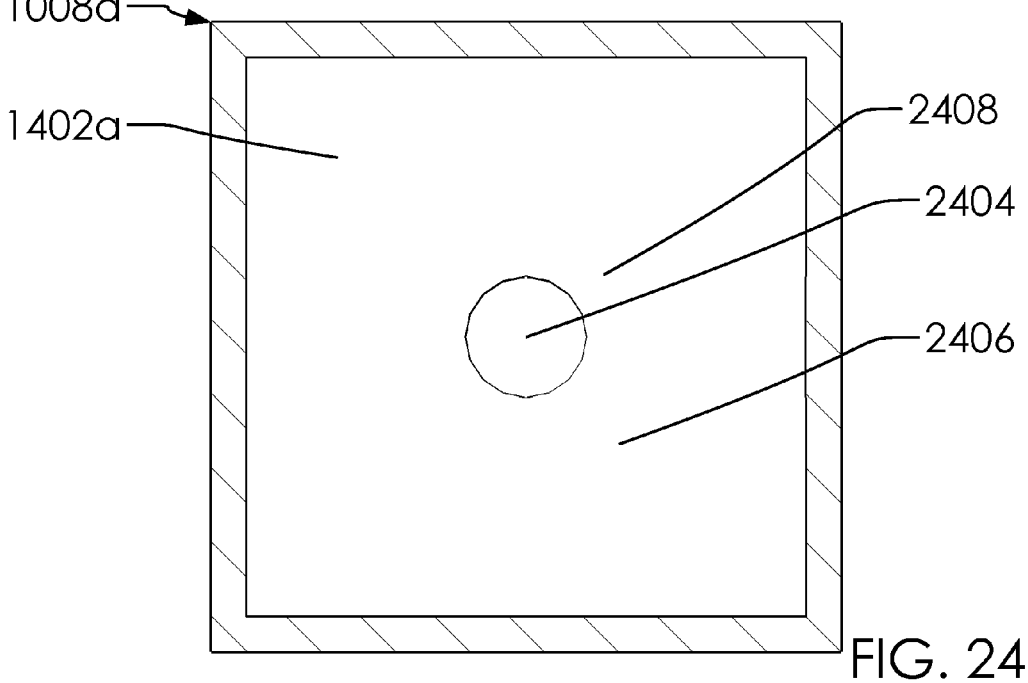
FIG. 24B is a top elevated view of a one or more storage segments of said outer body such as said first segment.

FIG. 24B is a top elevated view of a one or more storage segments of said outer body 1004 such as said first segment 1008*a*. Said first segment 1008*a* can comprise a threaded portion 1304, an outer surface 1306, said inner surface 1308, and said central support 1402*a*. In one embodiment said plate may have an aperture 2404. In one embodiment, said aperture 2404 can be fitted around said inner rod 102. In one embodiment, said central support 1402*a* can comprise a rectangular side 2406 with an oblong center portion 2408. In one embodiment, said oblong center portion 2408 can comprise an oval shape.

Figure 25A:
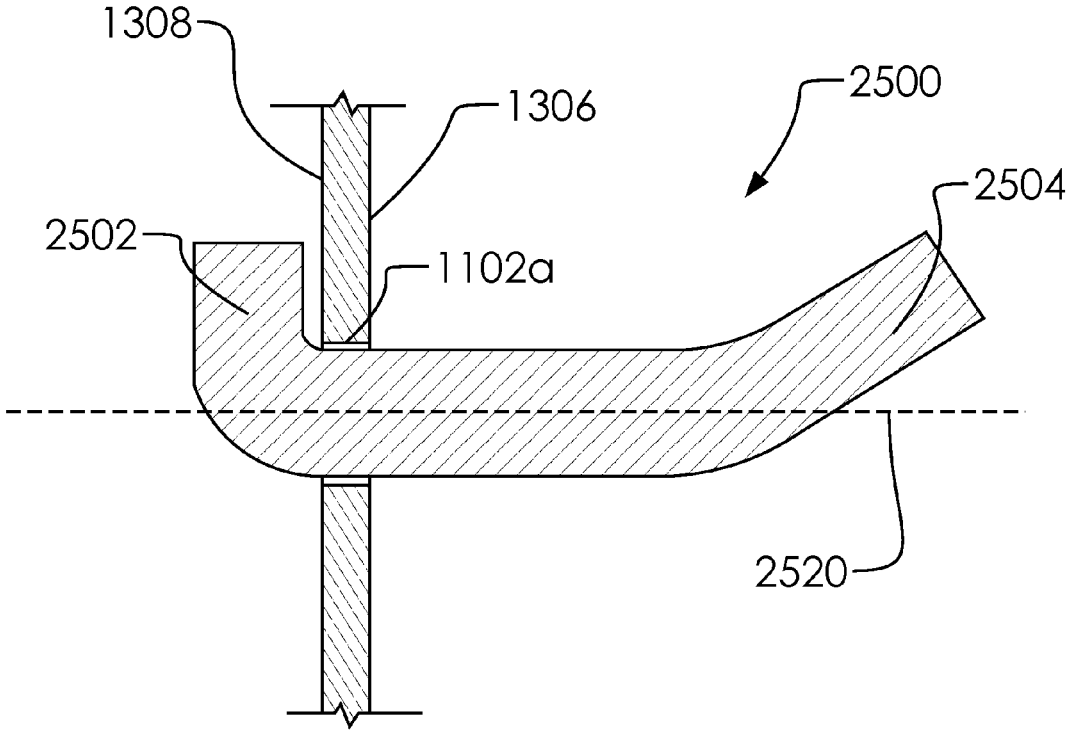
FIG. 25A illustrates a side elevated view and a front cross-section elevated view of a peg assembly.

FIG. 25A illustrates a side elevated view and a front cross-section elevated view of a peg assembly 2500. In one embodiment, said 2500 can attach to one of said plurality of apertures (which can comprise one among said first large aperture 1102*a*, said second large aperture 1102*b* and/or said third large aperture 1102*c*). In one embodiment, said peg assembly 2500 can comprise an inner portion 2502 which can comprise a portion held within said segment and an outer portion 2504 which can comprise a portion held outside of said segment.

In one embodiment, said hook assembly comprises a hook 2502 and an end 2504. In one embodiment, said hook 2502 can be inserted into said first large aperture 1102*a* in said outer body 1004 of said storage system 1000, holding said hook 2502 in place. In one embodiment, said end can be a curved peg. In one embodiment, said curved end can be used to hang articles of clothing. In one embodiment, said hook assembly 2500 can be used in multiple apertures. In one embodiment, multiple said hook assembly 2500 systems can be used to uniquely hang any object that can be hung.

Figure 25B:
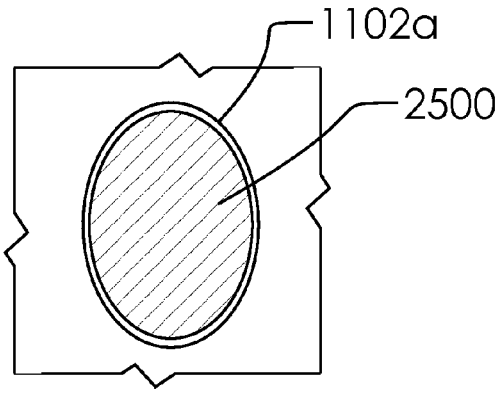

FIG. 25B illustrates an elevated front view of said first large aperture 1102*a* with a cross-section view of said peg assembly 2500 there-through. In one embodiment, said peg assembly 2500 can comprise an oval or elliptical shaped cross-section being similar to the shape of said first large aperture 1102*a* and a little smaller in dimensions. Accordingly, said peg assembly 2500 can pass through said plurality of apertures (such as said first large aperture 1102*a*) but may be prohibited from rotating about a central horizontal axis 2520.

Figure 25C:
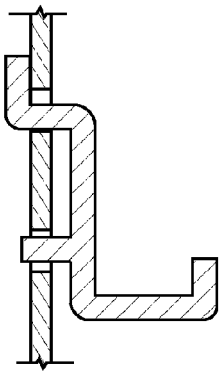
FIG. 25C illustrates a second hook assembly of common knowledge that may fit in a peg board.

FIG. 25C illustrates a second hook assembly 2504 of common knowledge that may fit in a peg board.

Figure 26:
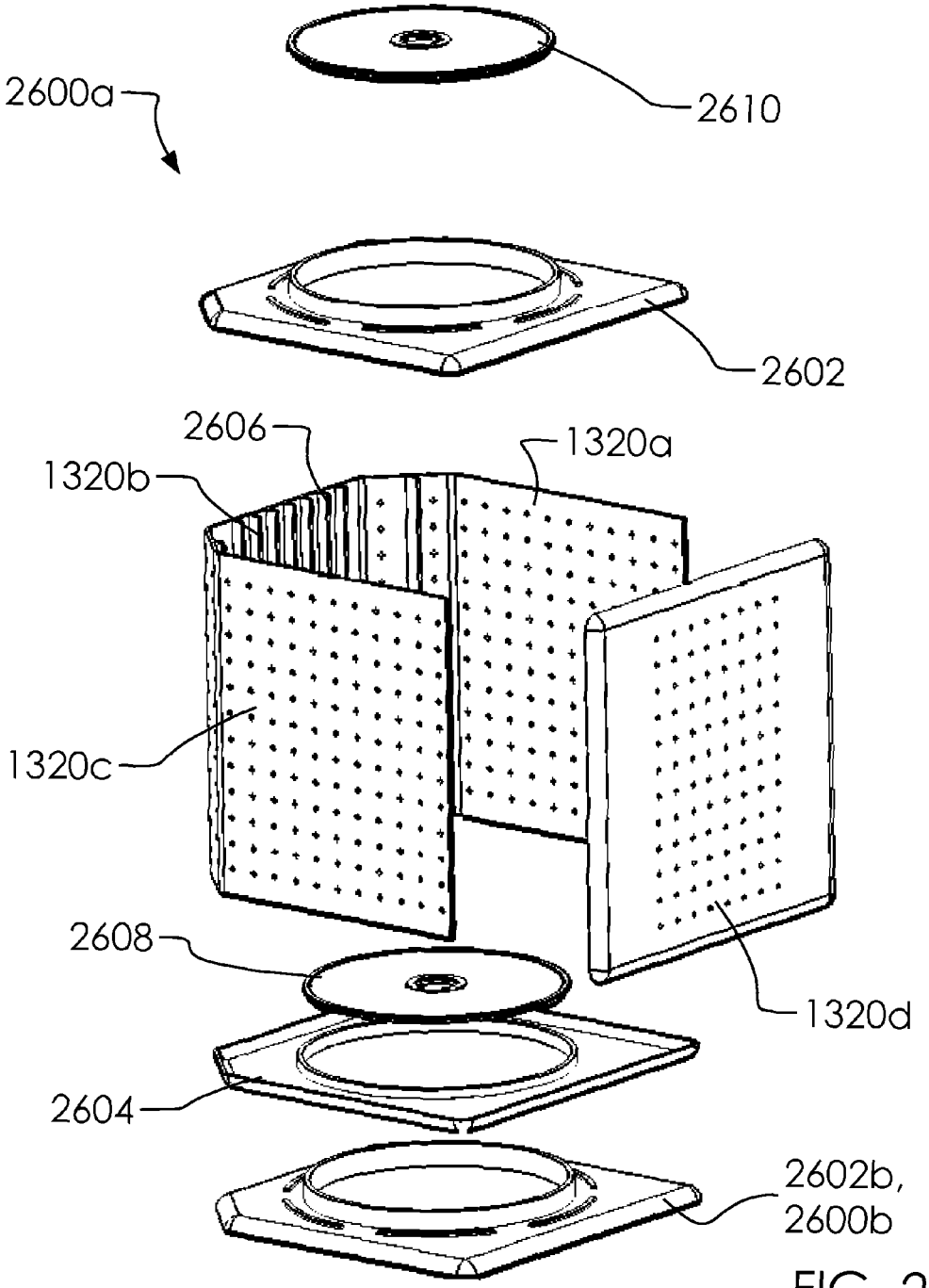
FIG. 26 illustrates an exploded perspective overview of a first segment 2600*a*.

FIG. 26 illustrates an exploded perspective overview of a first segment 2600*a*.

In one embodiment, said first segment 2600*a* can comprise one among said one or more storage segments.

In one embodiment, said first segment 2600*a* can comprise a top surface 2602, a bottom surface 2604, a three side panel enclosure 2606 (comprising of said first side panel 1320*a*, said second side panel 1320*b*, and said third side panel 1320*c*), said fourth side panel 1320*d*, a lower spacer 2608, and an upper spacer 2610.

As illustrated, said bottom surface 2604 of said first segment 2600*a* can selectively mate with an upper surface 2602*b* of a second segment 2600*b*.

In one embodiment, said plurality of side panels can comprise said first side panel 1320*a*, said second side panel 1320*b*, said third side panel 1320*c*, and said fourth side panel 1320*d*. In one embodiment, said three side panel enclosure 2606 can be used without said fourth side panel 1320*d* to form said plurality of side panels. In one embodiment, said lower spacer 2608 and/or said upper spacer 2610 can be used to center said one or more storage segments around said inner rod 102. In one embodiment, said bottom surface 2604 can mate with said top surface 2602.

Figure 27:
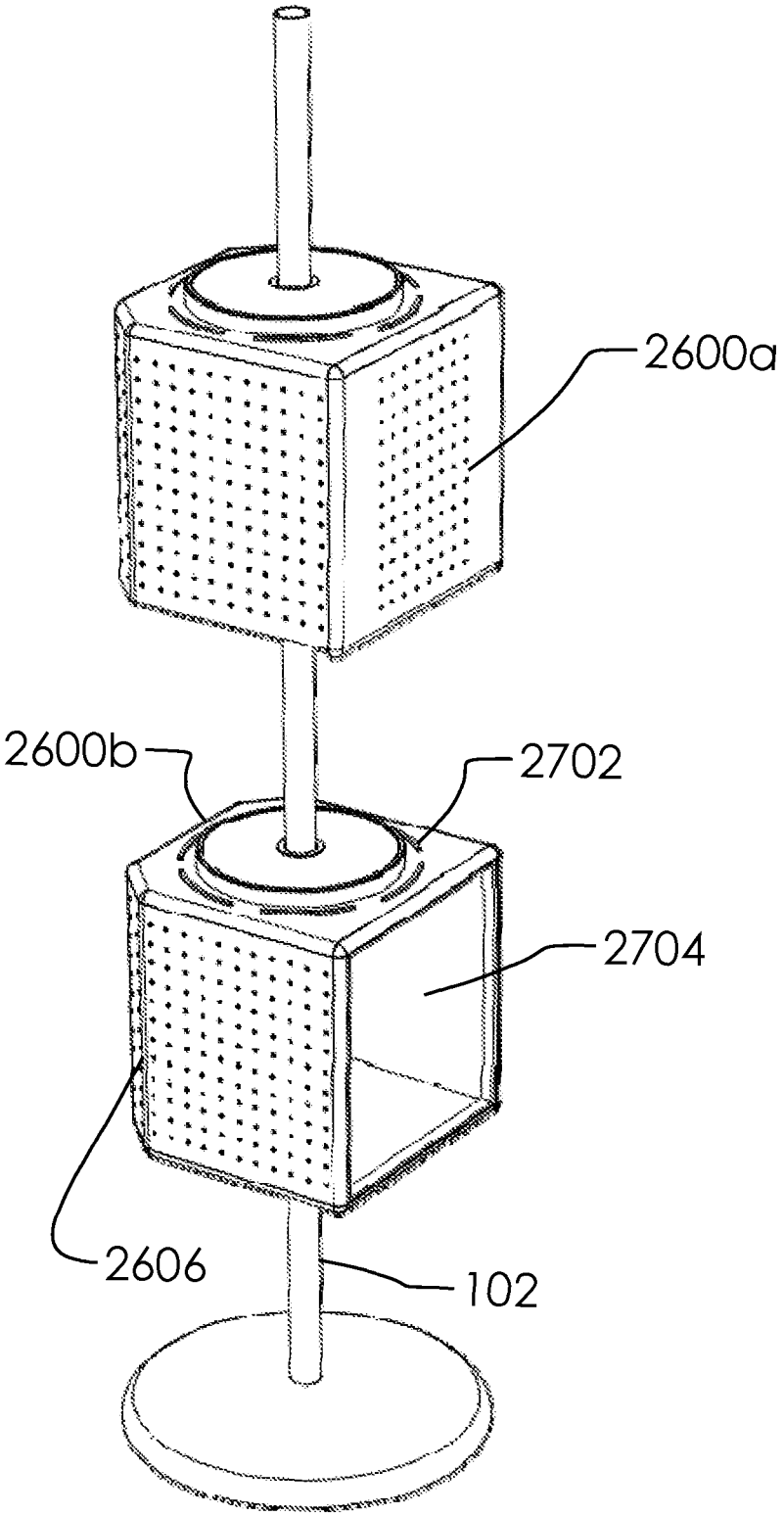
FIG. 27 illustrates a perspective overview of said storage system 100 with said first segment 2600*a* and said second segment 2600*b*.

FIG. 27 illustrates a perspective overview of said storage system 100 with said first segment 2600*a* and said second segment 2600*b*.

In one embodiment, said second segment 2600*b* (as with all among said one or more storage segments) can comprise a gasket 2702 on said top surface 2602 for cushion and grip between said one or more storage segments.

In one embodiment, said one or more storage segments can comprise a two or more storage segments, where said storage system 100 and/or said storage system 1000 require more than one segment for implementation.

In one embodiment, said one or more storage segments can comprise a compartment 2704 between said top surface 2602 and said bottom surface 2604. In one embodiment, said compartment 2704 can be partially enclosed by said plurality of side panels. In one embodiment, said compartment 2704 can be partially enclosed by said three side panel enclosure 2606.

Figure 28A:
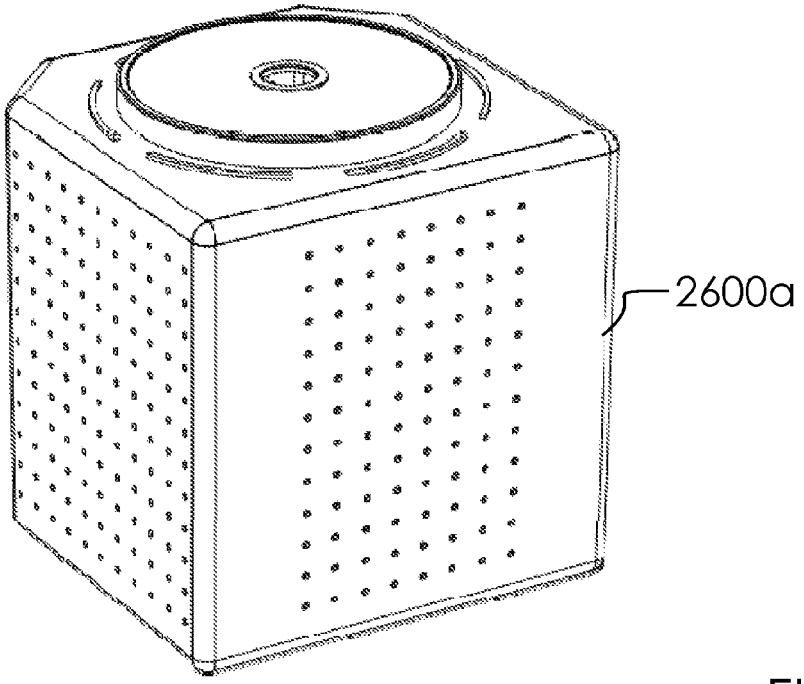
FIGS. 28A and 28B illustrate a perspective overview of said first segment 2600*a* and a portion thereof.
Figure 28B:
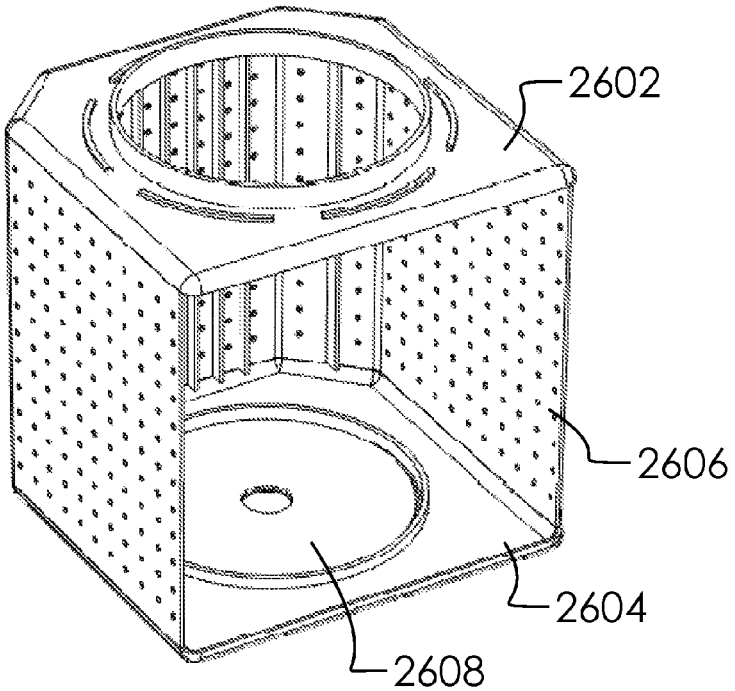

FIGS. 28A and 28B illustrate a perspective overview of said first segment 2600*a* and a portion thereof.

Figure 29A:
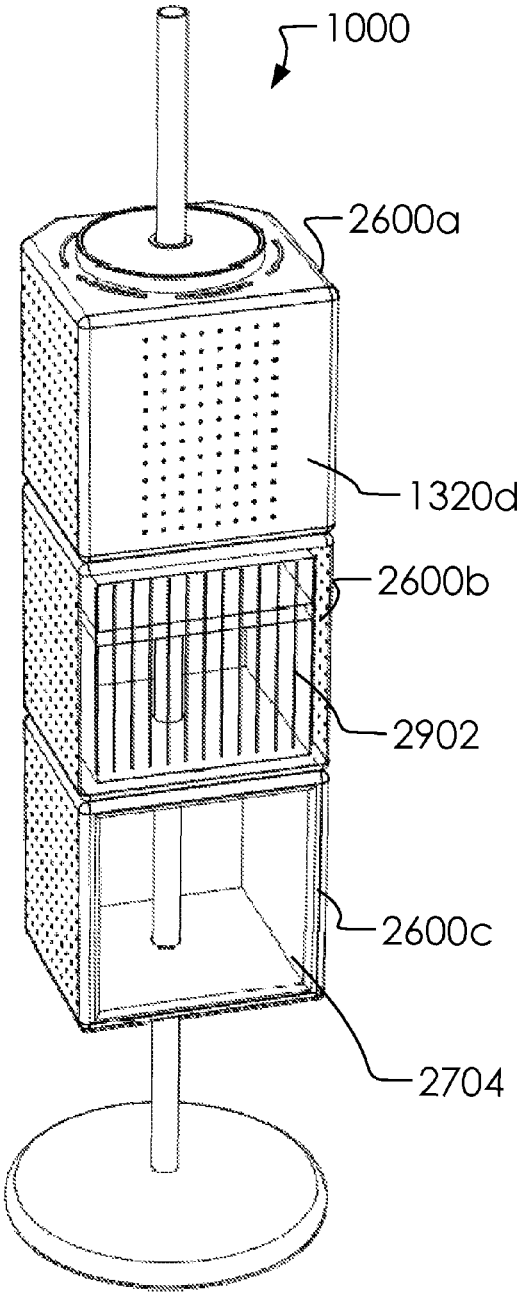
FIGS. 29A and 29B illustrate a first side and a second side perspective overview of said storage system 1000.
Figure 29B:
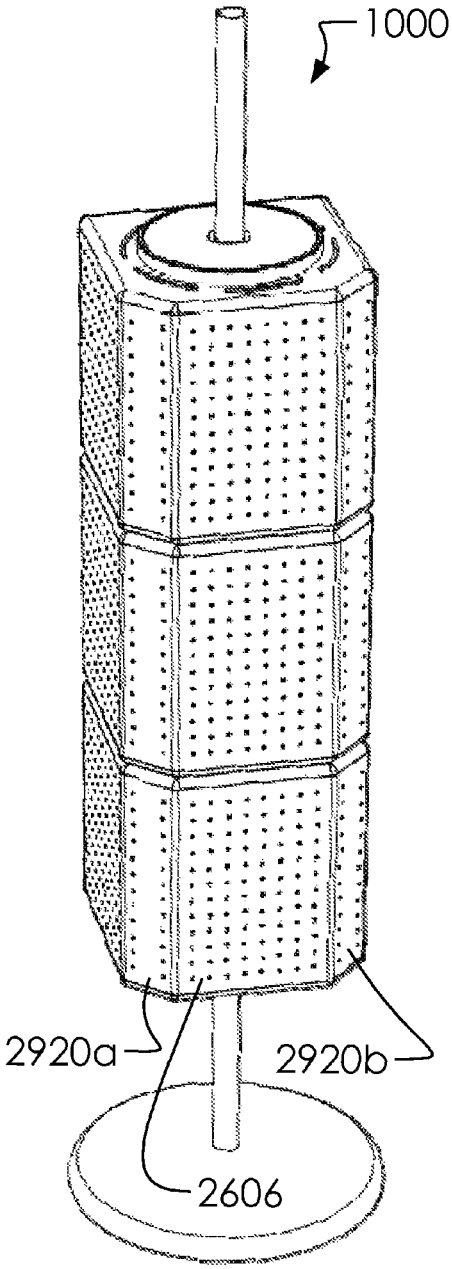

FIGS. 29A and 29B illustrate a first side and a second side perspective overview of said storage system 1000.

In one embodiment, said storage system 1000 can comprise said first segment 2600*a*, said second segment 2600*b*, and a third segment 2600*c*. In one embodiment, said one or more storage segments can comprise said fourth side panel 1320*d*, a mail compartment 2902, and/or said compartment 2704.

In one embodiment, said mail compartment 2902 can comprise a plurality of slots 2904 for receiving mail parcels, as is known in the art.

In one embodiment, said three side panel enclosure 2606 can comprise a first corner panel 2920*a* and a second corner panel 2920*b*, as illustrated.

Figure 30:
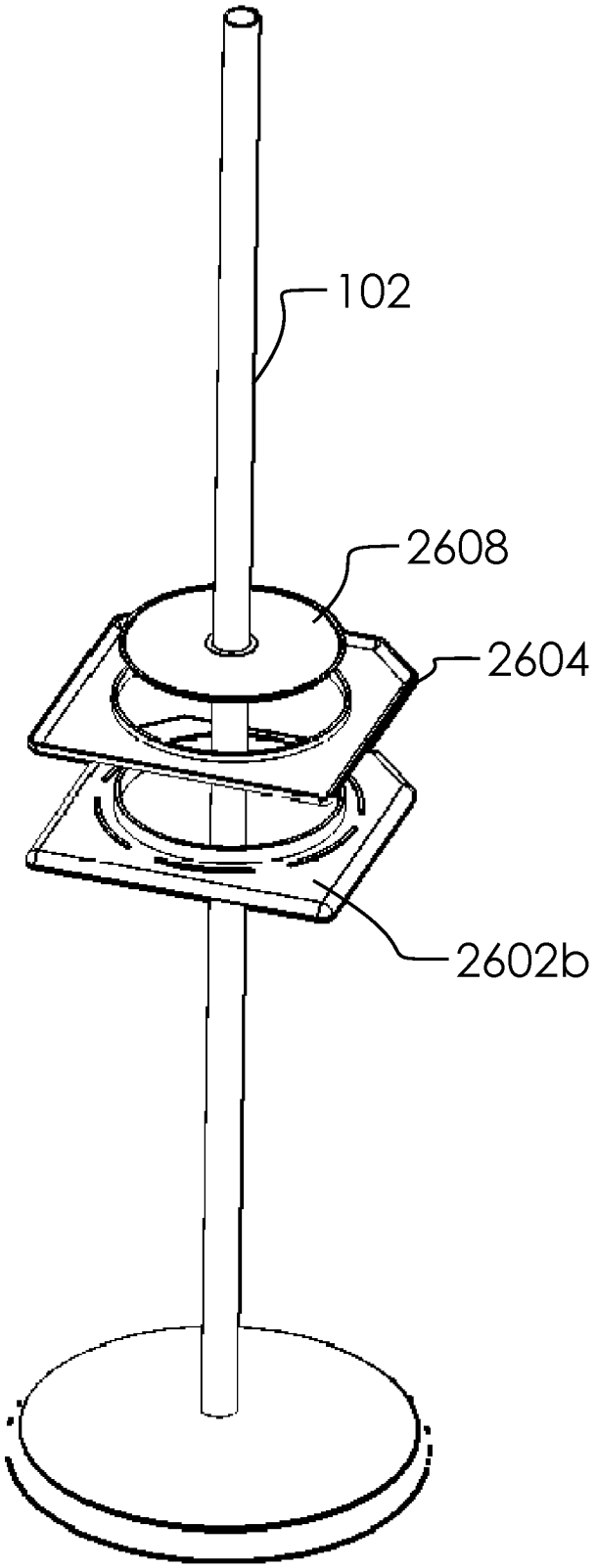
FIG. 30 illustrates a perspective overview of a portion of said storage system 1000.

FIG. 30 illustrates a perspective overview of a portion of said storage system 1000.

In one embodiment, said lower spacer 2608 can comprise a portion of said one or more storage segments that ensure said one or more storage segments remain centered on said inner rod 102, as is known in the art and illustrated.

Figure 31:
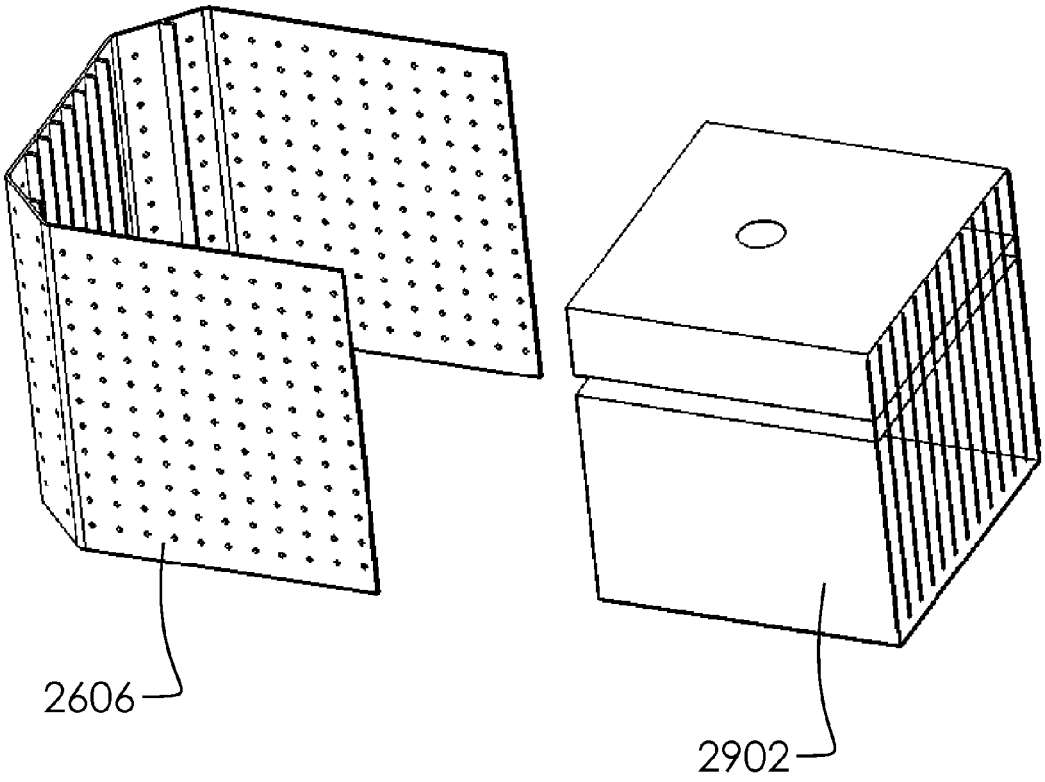
FIG. 31 illustrates an exploded perspective overview of said three side panel enclosure 2606 and said mail compartment 2902.

FIG. 31 illustrates an exploded perspective overview of said three side panel enclosure 2606 and said mail compartment 2902.

Figure 32:
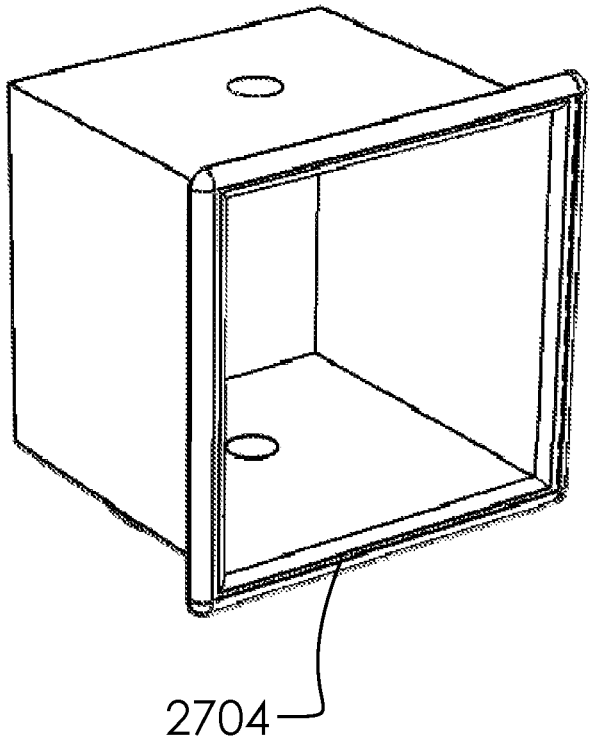
FIG. 32 illustrates a perspective overview of said compartment 2704.

FIG. 32 illustrates a perspective overview of said compartment 2704.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. A storage system comprising:

a storage system having an inner rod, an outer body and a lower foot;

said inner rod selectively attaches to said lower foot;

said outer body comprising two or more storage segments;

said inner rod comprising a substantially cylindrical shape, being aligned with a central vertical axis;

said two or more storage segments selectively slide over said inner rod;

said two or more storage segments are configured to rotate around said inner rod;

said two or more storage segments comprise a first segment and a second segment;

said two or more storage segments each comprise a top surface, a bottom surface, a plurality of side panels, a base portion on said top surface or bottom surface, and a socket portion being across from said base portion in said top surface or bottom surface;

said top surface of said two or more storage segments releaseably mate with said bottom surface of another among said two or more storage segments;

said storage system further comprises an upper foot; wherein, said upper foot is configured to press against a ceiling;

said lower foot is configured to press against a ground surface;

said inner rod comprises a tension rod having a variable length;

said inner rod comprises a first rod and a second rod;

said first rod comprises a outer threading;

said second rod comprises an inner threading;

said first rod selectively screws into said second rod so as to alter a length of said inner rod between said ground surface and said ceiling;

segments comprise a substantially cubical shape;

said plurality of side panels comprise at least a first side panel, a second side panel, a third side panel, and a fourth side panel;

said plurality of side panels comprise at least one side being open to expose a storage compartment between the others among said plurality of side panels, said bottom surface and said top surface;

said two or more storage segments comprise at least one of plastic, wood, ceramic, glass, metal, and biological material;

said socket portion comprising a female threading, said base portion comprising a male threading; and said top surface of said two or more storage segments is configured to releaseably mate with said bottom surface of another among said two or more storage segments by threading said male threading of said base into said female threading of said socket.

2. A storage system comprising:

a storage system having an inner rod, an outer body and a lower foot;

said inner rod selectively attaches to said lower foot;

said outer body comprising two or more storage segments;

said inner rod comprising a substantially cylindrical shape, being aligned with a central vertical axis;

said two or more storage segments selectively slide over said inner rod;

said two or more storage segments are configured to rotate around said inner rod;

said two or more storage segments comprise a first segment and a second segment;

said two or more storage segments each comprise a top surface, a bottom surface, a plurality of side panels, a base portion on said top surface or bottom surface, and a socket portion being across from said base portion in said top surface or bottom surface;

said top surface of said two or more storage segments releaseably mate with said bottom surface of another among said two or more storage segments;

said storage system further comprises an upper foot wherein, said upper foot is configured to press against a ceiling;

said lower foot is configured to press against a ground surface; and said inner rod comprises a tension rod having a variable length;

said inner rod comprises a first rod and a second rod;

said first rod comprises an outer threading;

said second rod comprises an inner threading; and said first rod selectively screws into said second rod so as to alter a length of said inner rod between said ground surface and said ceiling.

3. The storage system of claim 2 wherein:

said two or more storage segments comprise a substantially cubical shape; and said plurality of side panels comprise at least a first side panel, a second side panel, a third side panel, and a fourth side panel.

4. The storage system of claim 2 wherein: said plurality of side panels comprise at least a first side panel, a second side panel, and a third side panel; said plurality of side panels are enclosed on three sides at-a-said first side panel, said second side panel and said third side panel, but remains open at a fourth side of said two or more storage segments; and said fourth side being open to expose a storage compartment between the others among said plurality of side panels, said bottom surface and said top surface.

5. The storage system of claim 4 wherein:

said fourth side configured to selectively receive a fourth side panel.

6. The storage system of claim 2 wherein:

said plurality of side panels comprise at least one side being open to expose a storage compartment between the others among said plurality of side panels, said bottom surface and said top surface.

7. The storage system of claim 2 wherein:

said storage system further comprises one or more pegs; and said one or more pegs extend out from said outer body.

8. The storage system of claim 7 wherein:

said outer body comprises a pegboard comprising one or more apertures in said plurality of side panels;

said pegboard comprise an array of apertures arranged for receiving said one or more pegs, and said one or more pegs selectively attach to said one or more apertures.

9. The storage system of claim 2 wherein:

said two or more storage segments are configured to receive a set screw to prevent rotary movement of said outer body.

10. The storage system of claim 2 wherein:

said two or more storage segments comprise at least one of plastic, wood, ceramic, glass, metal, and biological material.

11. The storage system of claim 2 wherein:

said socket portion comprising a female threading, said base portion comprising a male threading; and said top surface of said two or more storage segments is configured to releaseably mate with said bottom surface of another among said two or more storage segments by threading said male threading of said base into said female threading of said socket.

12. The storage system of claim 2 wherein: said storage system further comprises a top segment; wherein, a portion of said inner rod releaseably attaches to said upper foot; a portion of said two or more storage segments attach to said top segment; said top segment couples with and rotates about said upper foot; and said outer body rotates with said top segment.

13. The storage system of claim 2 wherein:

said bottom surface of said two or more storage segments comprises a central support comprising a center aperture being wrapped close to said inner rod; and said outer body rotates around said inner rod with said central support configured to support said outer body from substantial lateral movement.

14. The storage system of claim 13 wherein:

said central support comprises an intermediate spacer configured to rest between a lower aperture in said bottom surface of an upper segment in said two or more storage segments and a lower segment in said two or more storage segments.

15. A method of manufacturing a storage system comprising:

manufacturing a storage system comprising two or more storage segments of an outer body, one or more pegs, an inner rod, an upper foot, a lower foot, and a top segment; wherein, said outer body rotatably attaches to said inner rod;

said upper foot and said lower foot press against a ceiling and a ground surface;

said inner rod comprises a tension rod having a variable length;

said one or more pegs extend out from said outer body;

said inner rod selectively attaches to said lower foot said inner rod comprising a substantially cylindrical shape, being aligned with a central vertical axis;

said two or more storage segments selectively slide over said inner rod;

said two or more storage segments are configured to rotate around said inner rod;

said two or more storage segments comprise a first segment and a second segment said two or more storage segments each comprise a top surface, a bottom surface, a plurality of side panels, a base portion on said top surface or bottom surface, and a socket portion being across from said base portion in said top surface or bottom surface;

said top surface of said two or more storage segments releaseably mate with said bottom surface of another among said two or more storage segments;

said storage system further comprises an upper foot wherein, said upper foot is configured to press against a ceiling;

said lower foot is configured to press against a ground surface; and said inner rod comprises a tension rod having a variable length;

said inner rod comprises a first rod and a second rod;

said first rod comprises an outer threading;

said second rod comprises an inner threading; and said first rod selectively screws into said second rod so as to alter a length of said inner rod between said ground surface and said ceiling.

16. A storage system comprising:

a storage system having an inner rod, an outer body and a lower foot;

said inner rod selectively attaches to said lower foot;

said outer body comprising a two or more storage segments;

said inner rod comprising a substantially cylindrical shape, being aligned with a central vertical axis;

said two or more storage segments selectively slide over said inner rod;

said two or more storage segments are configured to rotate around said inner rod;

said two or more storage segments comprise a first segment and a second segment;

said two or more storage segments each comprise a top surface, a bottom surface, a plurality of side panels, a base portion on said top surface or bottom surface, and a socket portion being across from said base portion in said top surface or bottom surface;

said top surface of said two or more storage segments releaseably mate with said bottom surface of another among said two or more storage segments;

said socket portion comprising a female threading, said base portion comprising a male threading; and said top surface of said two or more storage segments is configured to releaseably mate with said bottom surface of another among said two or more storage segments by threading said male threading of said base into said female threading of said socket.

17. A storage system comprising:

a storage system having an inner rod, an outer body and a lower foot;

said inner rod selectively attaches to said lower foot;

said outer body comprising two or more storage segments;

said inner rod comprising a substantially cylindrical shape, being aligned with a central vertical axis;

said two or more storage segments selectively slide over said inner rod;

said two or more storage segments are configured to rotate around said inner rod;

said two or more storage segments comprise a first segment and a second segment;

said two or more storage segments each comprise a top surface, a bottom surface, a plurality of side panels, a base portion on said top surface or bottom surface, and a socket portion being across from said base portion in said top surface or bottom surface;

said top surface of said two or more storage segments releaseably mate with said bottom surface of another among said two or more storage segments;

said plurality of side panels comprise at least a first side panel, a second side, and a third side;

said plurality of side panels are enclosed on three sides at a said first side panel, said second side panel and said third side panel, but remains open at a fourth side of said two or more storage segments;

said fourth side being open to expose a storage compartment between the others among said plurality of side panels, said bottom surface and said top surface;

said storage compartment comprises an empty volume within said storage segments;

said empty volume substantially fills a space defined by three of said plurality of side panels on its sides, said top surface above and said bottom surface below; and said storage compartment is configured to selectively receive items for storage within said storage segment.

18. The storage system of claim 17 wherein: said storage system comprises a plurality of said storage compartments; said plurality of said storage compartment can be partially enclosed by said storage segments; said plurality of said storage compartments are configured for storing items.

* * * * *